US011655125B2

(12) United States Patent
Okuda et al.

(10) Patent No.: US 11,655,125 B2
(45) Date of Patent: May 23, 2023

(54) PASSENGER CONVEYOR AND GUIDE SHOE FOR PASSENGER CONVEYOR

(71) Applicant: Mitsubishi Electric Corporation, Tokyo (JP)

(72) Inventors: Ryu Okuda, Tokyo (JP); Kenta Shirai, Tokyo (JP); Takahiro Kondo, Fukuoka (JP); Hiroki Mori, Fukuoka (JP); Nobuyuki Sowa, Fukuoka (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 22 days.

(21) Appl. No.: 17/598,879

(22) PCT Filed: Jul. 11, 2019

(86) PCT No.: PCT/JP2019/027568
§ 371 (c)(1),
(2) Date: Sep. 28, 2021

(87) PCT Pub. No.: WO2020/208837
PCT Pub. Date: Oct. 15, 2020

(65) Prior Publication Data

US 2022/0153554 A1 May 19, 2022

(30) Foreign Application Priority Data

Apr. 12, 2019 (JP) ..... JP2019-076334

(51) Int. Cl.
*B66B 23/14* (2006.01)
*B66B 23/12* (2006.01)
*B66B 29/04* (2006.01)

(52) U.S. Cl.
CPC ..... *B66B 23/14* (2013.01); *B66B 23/12* (2013.01); *B66B 29/04* (2013.01)

(58) Field of Classification Search
CPC ..... B66B 23/12; B66B 23/14; B66B 29/04
USPC ..... 198/321–338
See application file for complete search history.

(56) References Cited

U.S. PATENT DOCUMENTS 4,746,000 A * 5/1988 Nakatani ..... B66B 21/06 198/328
5,988,350 A * 11/1999 Nusime ..... B66B 23/12 198/333

FOREIGN PATENT DOCUMENTS

| | | | |
|---|---|---|---|
| JP | 2001-146379 | A | 5/2001 |
| JP | 2011-190043 | A | 9/2011 |
| JP | 2013-10584 | A | 1/2013 |
| JP | 2013-56728 | A | 3/2013 |
| JP | 2013-249147 | A | 12/2013 |

(Continued)

OTHER PUBLICATIONS

International Search Report and Written Opinion dated Oct. 15, 2019, received for PCT Application PCT/JP2019/027568, Filed on Jul. 11, 2019, 9 pages including English Translation.

(Continued)

*Primary Examiner* — James R Bidwell
(74) *Attorney, Agent, or Firm* — Xsensus LLP

(57) ABSTRACT

Provided is a guide shoe for a passenger conveyor, including: a base portion to be slid across a skirt guard provided along a moving direction of a plurality of steps that are movably provided; and a weight containing a material having a specific gravity larger than a specific gravity of a material of the base portion, which is provided to the base portion.

12 Claims, 21 Drawing Sheets

(56) References Cited

FOREIGN PATENT DOCUMENTS

| | | | | |
|---|---|---|---|---|
| JP | 2014162617 A | * | 9/2014 | ..... B66B 23/12 |
| JP | 5968250 B2 | * | 8/2016 | ..... B66B 23/12 |

OTHER PUBLICATIONS

Kondo, "Elucidation of Mechanism of Generation of Self-Excited Vibration by New Complex Mode Analysis and Its Preventive Measures", 18th Autumn Technology Exchange Forum of the Japan Society of Mechanical Engineers, Oct. 21, 2017, pp. 10-12 (13 pages including English Translation).

* cited by examiner

Related Art

PASSENGER CONVEYOR AND GUIDE SHOE FOR PASSENGER CONVEYOR

CROSS-REFERENCE TO RELATED APPLICATIONS

The present application is based on PCT filing PCT/JP2019/027568, filed Jul. 11, 2019, which claims priority to JP 2019-076334, filed Apr. 12, 2019, the entire contents of each are incorporated herein by reference.

TECHNICAL FIELD

This invention relates to a passenger conveyor such as an escalator or a moving walk, and to a guide shoe for a passenger conveyor.

BACKGROUND ART

A related-art passenger conveyor includes balustrades and floor plates. The balustrades are installed in a building structure. The floor plates are installed at both ends of the balustrades in a longitudinal direction thereof. A plurality of steps that are connected endlessly are installed in such a manner as to circulate between the floor plates. Skirt guards are mounted to the balustrades along a moving direction of the steps in such a manner as to be located on both sides of the steps in a width direction thereof. Guide shoes are mounted at both sides of each of the steps in the width direction of the steps. With this configuration, when the steps are moved, the guide shoes are brought into contact with the skirt guards to restrict movement of the steps in the width direction (see, for example, Patent Literature 1).

In the passenger conveyor described above, when the guide shoes are moved while being in contact with the skirt guards, specifically, being slid across the skirt guards, the guide shoes cause friction vibration. As a result, a sliding noise is generated from the guide shoes or the vicinity thereof.

In the related-art passenger conveyor described in Patent Literature 1, the guide shoes are made of a low-friction material. Thus, generation of the sliding noise is suppressed. Further, in Non Patent Literature 1, the generation of vibration is described in mathematical terms.

CITATION LIST

Patent Literature

[PTL 1] JP 2011-190043

Non Patent Literature

[NPL 1] "Elucidation of Mechanism of Generation of Self-Excited Vibration by New Complex Mode Analysis and Its Preventive Measures" by Takahiro Kondo, pp. 10 to 12, 18th Autumn Technology Exchange Forum of The Japan Society of Mechanical Engineers, Kansai Branch (Oct. 21, 2017).

SUMMARY OF INVENTION

Technical Problem

In the related-art passenger conveyor, the guide shoes are made of a low-friction material. Thus, the generation of the sliding noise can be suppressed by an effect of the low-friction material for a predetermined time period after mounting of new guide shoes. However, a friction coefficient of a sliding surface of each of the guide shoes increases over time. Thus, the generation of the sliding noise cannot be continuously suppressed through operations of the passenger conveyor for a long period of time.

This invention has been made to solve the problems described above, and has an object to provide a passenger conveyor and a guide shoe for a passenger conveyor, which enable suppression of generation of a sliding noise for a long period of time even when a friction coefficient of a sliding surface of the guide shoe has increased over time.

Solution to Problem

According to one embodiment of the present invention, there is provided a guide shoe for a passenger conveyor, including: a base portion to be slid across a skirt guard provided along a moving direction of a plurality of steps that are movably provided; and a weight containing a material having a specific gravity larger than a specific gravity of a material of the base portion, which is provided to the base portion.

Advantageous Effects of Invention

According to one embodiment of the present invention, the weight containing a material having a specific gravity larger than a specific gravity of a material of the base portion is provided to the base portion of the guide shoe for a passenger conveyor to increase a mass at a mass point. Thus, even when a friction coefficient of the base portion has increased over time, friction vibration of the guide shoe can be suppressed. Thus, suppression of a sliding noise through operations of the passenger conveyor for a long period of time is achieved.

DESCRIPTION OF EMBODIMENTS

First Embodiment

Figure 1:
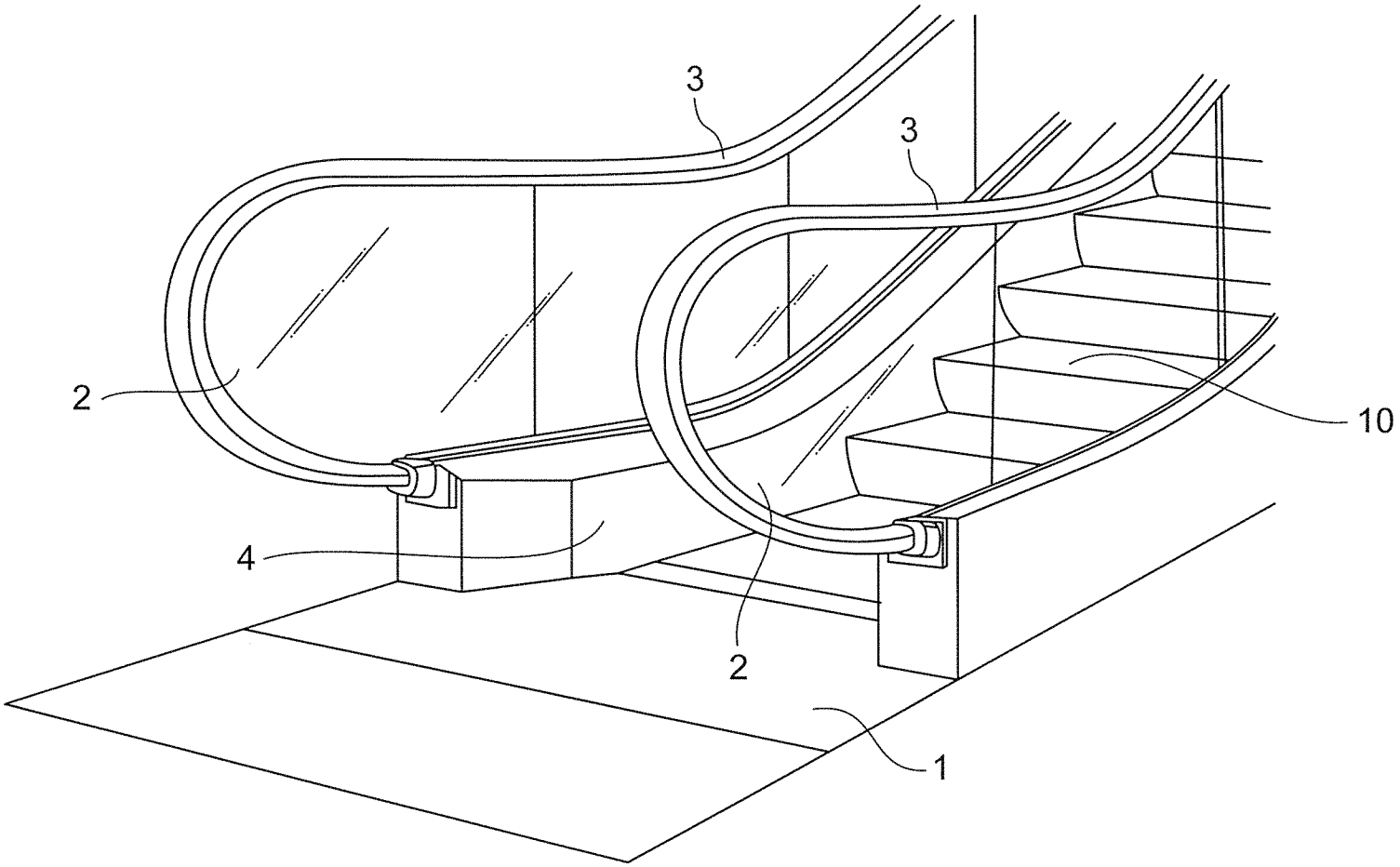
FIG. 1 is a perspective view for illustrating a main part of a passenger conveyor according to a first embodiment of this invention.

FIG. 1 is a perspective view for illustrating a main part of a passenger conveyor according to a first embodiment of this invention.

In FIG. 1, the passenger conveyor includes floor plates 1, a plurality of steps 10, balustrades 2, handrails 3, and skirt guards 4. The floor plate 1 is installed on each floor of a building. The plurality of steps 10 are connected endlessly and provided in a circulatable manner between the floor plate 1 on an upper floor and the floor plate 1 on a lower floor. The balustrades 2 are installed on both sides of the steps 10 in a width direction of the steps 10 along a moving direction of the steps 10. The balustrades 2 are installed in such a manner as to be separate from each other in the width direction of the steps 10 and parallel to each other. The handrail 3 is provided along an outer periphery of each of the balustrades 2, and is configured to be moved in synchronization with movement of the steps 10. The skirt guard 4 is provided below each of the balustrades 2.

Figure 2:
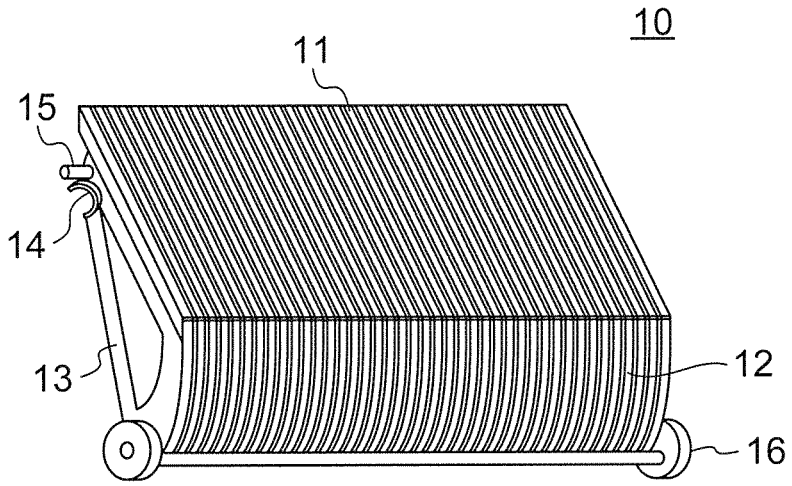
FIG. 2 is a perspective view of a step of the passenger conveyor according to the first embodiment of this invention.
Figure 3:
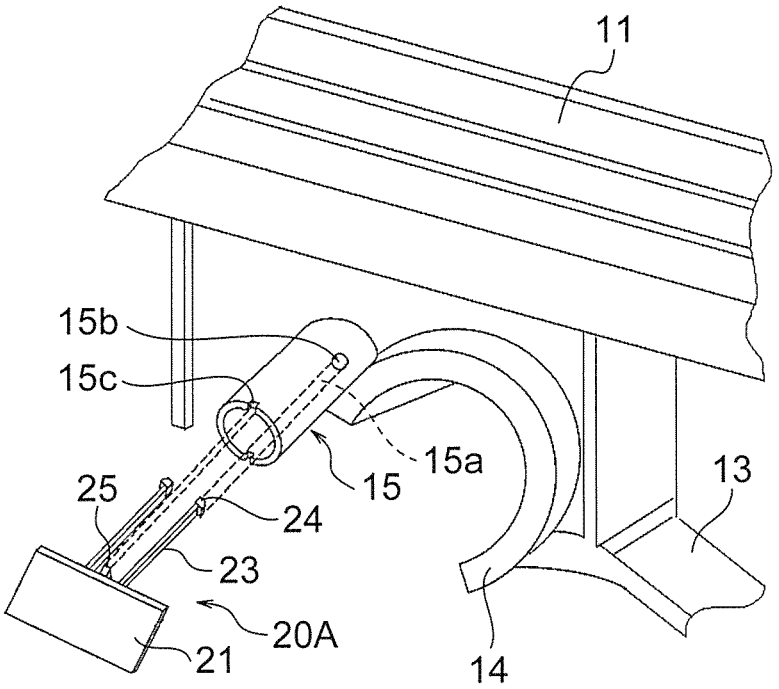
FIG. 3 is an enlarged perspective view for illustrating a main part of the step of the passenger conveyor according to the first embodiment of this invention.
Figure 4:
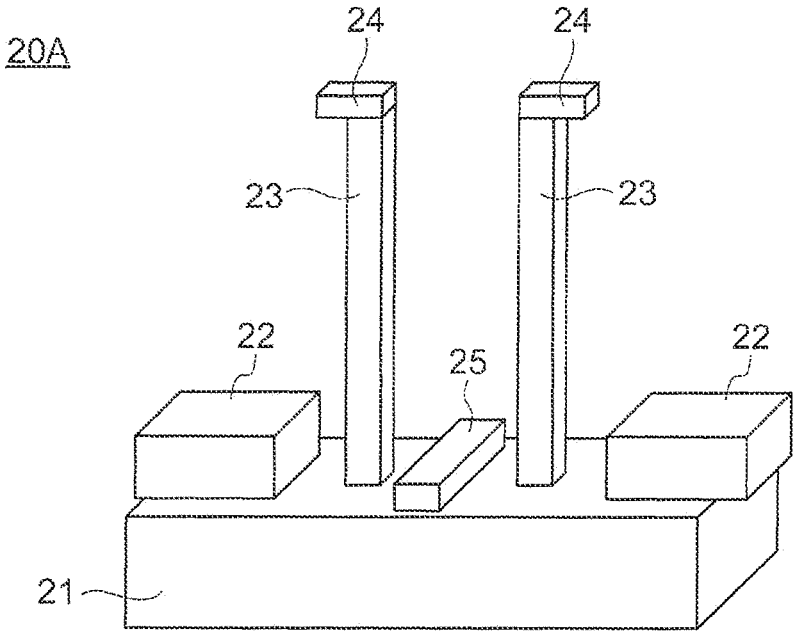
FIG. 4 is a perspective view of a guide shoe according to the first embodiment of this invention, which is to be mounted to a step of the passenger conveyor.

Next, a configuration of each of the steps 10 is described with reference to FIG. 2 to FIG. 4. FIG. 2 is a perspective view of one of the steps of the passenger conveyor according to the first embodiment of this invention. FIG. 3 is an enlarged perspective view for illustrating a main part of a step of the passenger conveyor according to the first embodiment of this invention. FIG. 4 is a perspective view of a guide shoe according to the first embodiment of this invention, which is to be mounted to a step of the passenger conveyor.

The step 10 includes, as illustrated in FIG. 2, a step tread 11, a riser 12, and triangular brackets 13. The step tread 11 is configured to allow a passenger to stand thereon. The riser 12 is a stair riser. The triangular brackets 13 are arranged on a side opposite to a tread surface of the step tread 11 in such a manner as to be separate from each other in a width direction of the step tread 11. The triangular brackets 13 are frames configured to support both ends of the step tread and the riser 12 in the width direction. A fitting portion 14 having a C-like shape is provided to an end portion of each of the triangular brackets 13, which is on a side opposite to the riser 12. A connector (pipe sleeve) 15 configured to enable mounting of a guide shoe 20A is provided to each of the triangular brackets 13. The connector 15 is provided on a side of the fitting portion 14, which is opposite to the riser 12, in such a manner as to be adjacent to the fitting portion 14. A rear wheel 16 is provided at an end portion of each of the triangular brackets 13, which is on the riser 12 side. Although not shown, a step front-wheel shaft is fitted into the fitting portions 14 of the triangular brackets 13. Then, front wheels are mounted to both ends of the step front-wheel shaft. The front wheels, which are mounted to the step front-wheel shafts, are connected through intermediation of endless step chains.

Although not shown, the front wheels of the steps 10 having the configuration described above are connected to the endless step chains, and the steps 10 are installed endlessly between the floor plate 1 on the upper floor and the floor plate on the lower floor. Then, the step chains are driven to circulate the steps 10 between the floor plate 1 on the upper floor and the floor plate 1 on the lower floor.

In this case, as illustrated in FIG. 3, the connector 15 is formed in a cylindrical shape, and is provided to each of the triangular brackets 13 in such a manner that an axial direction of the connector 15 matches the width direction of the step tread 11. Further, in some passenger conveyors, the connector 15 may have a rectangular parallelepiped shape as a member configured to enable the mounting of the guide shoe 20A. Specifically, the connector 15 is a structure configured to enable the mounting of the guide shoe 20A or to hold a base portion 21 of the guide shoe 20A, which is described later, in the passenger conveyor. The connector 15 is formed in such a manner that a protruding amount of the connector 15 beyond the step 10 lies within a specified range. The axial direction of the connector 15 is perpendicular to a sliding surface of the skirt guard 4 across which the base portion 21 of the guide shoe 20A is to be slid, which is described later. A contact surface of the connector 15, which is an axially outer end surface of the connector 15, is a flat surface orthogonal to the axial direction of the connector 15. A pair of guide grooves 15*a* are formed in an inner wall of a peripheral wall portion of the connector 15. The pair of guide grooves 15*a* are formed so as to be opposed to each other across an axis of the connector 15 and to extend in parallel to the axis. A pair of insertion holes 15*b* are formed in the peripheral wall portion of the connector 15. The pair of insertion holes 15*b* are formed so as to be opposed to each other across the axis of the connector 15 in such a manner as to bring the pair of guide grooves 15*a* and an outside of the connector 15 into communication with each other. A pair of fitting grooves 15*c* are formed in the contact surface of the connector 15 so as to be opposed to each other across the axis of the connector 15. A direction in which the pair of guide grooves 15*a* are opposed to each other is orthogonal to a direction in which the pair of fitting grooves 15*c* are opposed to each other.

The guide shoe 20A includes, as illustrated in FIG. 4, the base portion 21, weights 22, a pair of leg portions 23, claw portions 24, and a protruding portion 25. The base portion 21 is to be slid across the sliding surface of the skirt guard 4 when the steps 10 are moved. The weights 22 are configured to add a mass to the base portion 21. The pair of leg portions 23 are configured to enable mounting of the base portion 21 to the connector 15. The claw portions 24 are provided at distal ends of the leg portions 23, respectively. The protruding portion 25 is configured to position the base portion 21.

The base portion 21 is a low friction material, and is formed in a flat rectangular parallelepiped shape using a material having appropriate elasticity, such as a polyacetal resin, a polytetrafluoroethylene resin, a polyamide resin, a polyethylene resin, a polyphenylene sulfide resin, a polyolefin resin, a phenol resin, or a polyether ether ketone resin. The weights 22 are mounted to a surface of the base portion 21 on a side opposite to a sliding surface of the base portion 21, which is to be slid across the sliding surface of the skirt guard 4, that is, a back surface of the base portion 21 by bonding or welding in a state of being in contact with the base portion 21. The weights 22 are provided in the vicinity of short sides of the rectangular back surface of the base portion 21 in such a manner as to be separate from each other in a longitudinal direction of long sides of the back surface. Each of the weights 22 is formed in a rectangular parallelepiped shape with use of a material having a specific gravity larger than that of a material of the base portion 21, for example, a metal such as iron, aluminum, copper, lead, or tungsten, a stone material, and glass. The pair of leg portions 23 are formed so as to extend from the back surface of the base portion 21 in a direction perpendicular to the sliding surface of the base portion 21. The claw portions 24 are provided in such a manner as to protrude outward from protruding ends of the pair of leg portions 23 in a direction in which the leg portions 23 are opposed to each other. The protruding portion 25 has such a shape that can be fitted into the fitting grooves 15*c*, and is provided at a central position between the pair of leg portions 23 on the back surface of the base portion 21. The protruding portion 25 extends in a direction orthogonal to the direction in which the pair of leg portions 23 are opposed to each other.

To mount the guide shoe 20A having the configuration described above to the step 10, the pair of leg portions 23 are first elastically deformed in such a manner as to reduce a distance between the claw portions 24, and the claw portions 24 are inserted into the pair of guide grooves 15*a*. Subsequently, the pair of leg portions 23 are inserted into the connector 15. In this manner, the claw portions 24 are moved in the pair of guide grooves 15*a*. When the claw portions 24 reach positions of the insertion holes 15*b*, the leg portions 23 return to their original states to thereby fit the pair of claw portions 24 into the insertion holes 15*b*. At this time, the protruding portion 25 is inserted into the fitting grooves 15*c*. As a result, the guide shoe 20A is mounted to the step 10 with the base portion 21 being located on an outer side in the width direction of the step tread 11. The claw portions 24 inserted into the insertion holes 15*b* prevent disengagement of the guide shoe 20A from the connector 15. Further, the protruding portion 25 fitted into the fitting grooves 15*c* prevents rotation of the guide shoe 20A about the axis of the connector 15 and positions the guide shoe 20A. Further, the weights 22 are in contact with the base portion 21, and are separate from components of the step 10, such as the step tread 11, the riser 12, the triangular bracket 13, and the connector 15, and the skirt guard 4.

Figure 5:
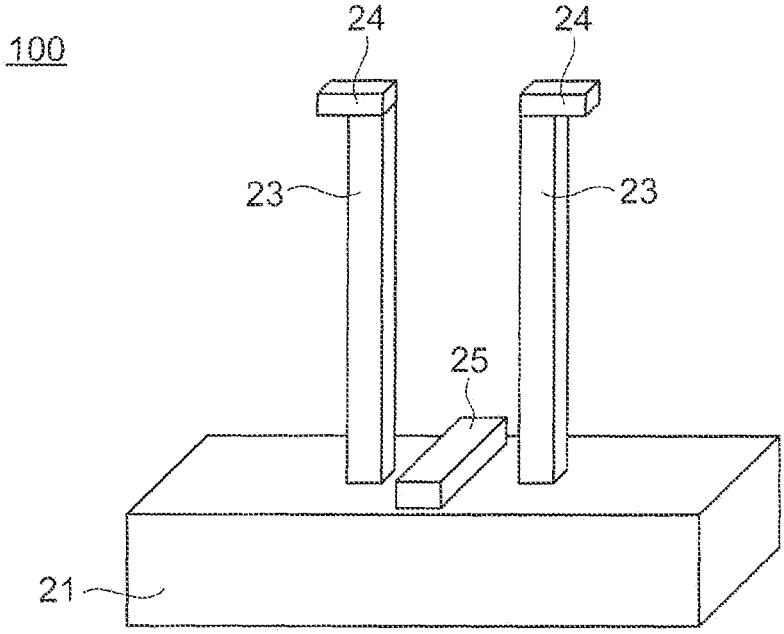
FIG. 5 is a perspective view of a related-art guide shoe to be mounted to a step of a passenger conveyor.

FIG. 5 is a perspective view of a related-art guide shoe to be mounted to a step of a passenger conveyor. As illustrated in FIG. 5, the related-art guide shoe 100 has the same configuration as that of the guide shoe 20A of the present application except that the weights 22 are not provided.

Now, a description is given of a schema of a phenomenon of generation of an abnormal noise, which is caused along with sliding movement of the guide shoe, and dynamic effects of a guide shoe structure.

First, as a general sliding phenomenon, when one of two members is slid across the other one and a friction coefficient of a sliding surface becomes equal to or larger than a given value, a vibration amplitude of the member tends to significantly increase. However, this phenomenon is not determined based only on a magnitude of a value of the friction coefficient, but is also affected by other parameters. For example, vibration is suppressed by increasing a mass at a mass point portion in a friction vibration system.

In the present invention, the above-mentioned characteristics in the sliding phenomenon are applied to a structure of the guide shoe for a passenger conveyor.

The guide shoe 20A is subjected to a frictional force from the skirt guard 4 with the leg portions 23 mounted to the step 10 being fixed ends. A mass point portion in this friction vibration system corresponds to the base portion 21, which is located at a distal end of the guide shoe 20A. The related-art guide shoe 100 illustrated in FIG. 5 does not include the weights 22. Thus, a mass of the base portion 21 is small. Further, a friction coefficient of the sliding surface of the base portion 21, which is to be slid across the skirt guard 4, increases over time. Thus, when the related-art guide shoe 100 is used, generation of a sliding noise cannot be continuously suppressed through operations of the passenger conveyor for a long period of time.

Thus, for the suppression of vibration, it is effective to increase the mass of the base portion 21. When the weights 22 containing a material having a specific gravity larger than that of a material of the base portion are provided to the base portion 21, the vibration of the base portion 21 can be suppressed. However, when the weights 22 provided to the base portion 21 are brought into contact with a component of the step 10, such as the connector 15 of the step 10, which serves as a ground in the friction vibration system, and are supported by the component of the step 10, a desired increase in mass cannot be achieved at the mass point portion in some cases. An experiment was actually conducted under a state in which the weights were in contact with a component of the step. As a result, a reduction in vibration was not achieved in some cases. In the first embodiment, the weights 22 may be mounted to the base portion 21 in a state of being in contact only with the base portion 21 so as not to be brought into contact with the components of the step 10, such as the connector 15 of the step 10 and other components provided therearound. Specifically, the weights 22 are arranged in such a manner that a clearance is defined between the weights 22 and the components of the steps 10. In other words, the weights 22 are arranged so as not to be in contact with or so as to be separate from the components of the step 10, which include the connector 15 and the components provided therearound. Further, the guide shoe 20A may be mounted to the connector 15 in such a manner that the weights 22 are separate from the skirt guard 4. In the manner described above, the weights 22 add a mass to the base portion 21. Further, the weights 22 are made of a material having a specific gravity larger than that of a material of the base portion 21. According to the first embodiment, the mass of the base portion 21 can be efficiently increased while an increase in volume of the guide shoe 20A is reduced. As a result, even when the friction coefficient of the sliding surface of the base portion 21 has increased over time, the friction vibration of the guide shoe 20A can be suppressed. Thus, the suppression of the sliding noise through the operations of the passenger conveyor for a long period of time can be achieved.

Further, there exist a plurality of kinds of phenomena in which the vibration amplitude is increased due to an influence of the frictional force. The inventors have conducted an experiment and an investigation on the friction vibration of the guide shoe. As a result, it was found that, in a case of the guide shoe, a vibration destabilization phenomenon occurs due to asymmetry of a mass matrix, a stiffness matrix, and a damping matrix of the guide shoe.

Figure 6:
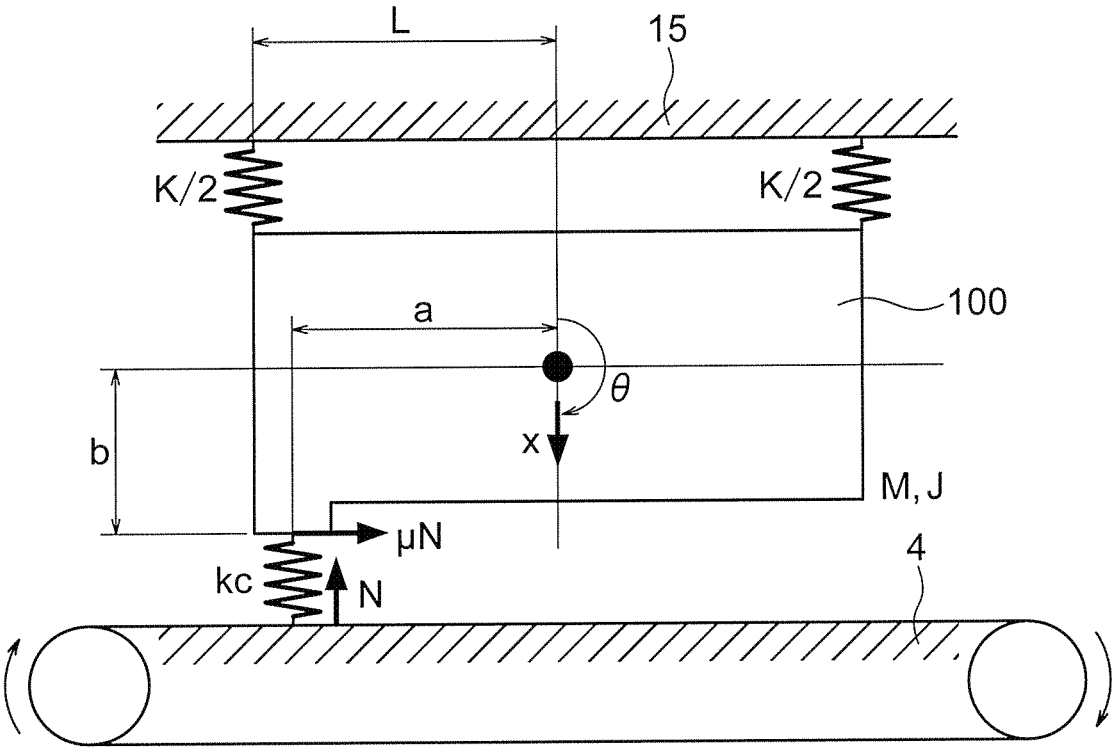
FIG. 6 is an analysis model diagram for illustrating a friction vibration phenomenon of the guide shoe for a passenger conveyor in a simplified manner.

FIG. 6 is an analysis model diagram for illustrating a friction vibration phenomenon of the guide shoe in a simplified manner. The guide shoe 100 is suspended from a horizontal upper support portion corresponding to the connector 15 through two hanger springs. The two hanger springs are connected to the upper support portion, and are provided at positions separate from each other in a horizontal direction. The guide shoe 100 is a rigid body having a mass M. A lower support portion corresponding to the skirt guard 4 is located below the guide shoe 100. A contact spring having a spring constant "$k_c$" is provided to the lower support portion so as to be in contact with the guide shoe 100. The guide shoe 100 is pressed against the lower support portion through the contact spring. The lower support portion is moved at a constant velocity with respect to the guide shoe 100 in the horizontal direction. A kinetic frictional force as a coulomb frictional force acts on the guide shoe 100 at a contact point of the contact spring with the guide shoe 100. Only a translational motion in a vertical direction and a rotational motion about a center of gravity are possible as motions of the guide shoe 100. The rotational motion of the guide shoe 100 about the center of gravity is a rotational motion in a plane that is orthogonal to the lower support portion and extends along a moving direction of the lower support portion. When a moment of inertia about the center of gravity of the guide shoe 100 is represented by J, a vertically downward displacement of the guide shoe 100 from a non-vibrational equilibrium state as a reference is represented by "x", and an angular displacement about the center of gravity is represented by θ, an equation of motion of this system is expressed by Expression (1).

[Math. 1]

$$\left.\begin{aligned} M\ddot{x} + Kx + k_c(x - a\theta) = 0 \\ J\ddot{\theta} + KL^2\theta - k_c(a - \mu b)(x - a\theta) = 0 \end{aligned}\right\} \tag{1}$$

In Expression (1), K/2 is a spring constant of each of the hanger springs, "$k_c$" is the spring constant of the contact spring, L is a dimension between the center of gravity of the guide shoe 100 and one of the hanger springs in the horizontal direction, μ is a dynamic friction system coefficient of the contact spring for the guide shoe 100, a sign of "a" is defined to be positive when "a" is on the left side of the center of gravity of the guide shoe 100 in FIG. 6, and "b" is a dimension between the contact point of the contact spring with the guide shoe 100 and the center of gravity of the guide shoe 100 in the vertical direction. A plurality of non-dimensional parameters are now introduced. Then, the equation of motion of this system is expressed by Expression (2).

[Math. 2]

$$\left.\begin{aligned} M\ddot{x} + Kx = 0,\ \text{“}\dot{}\text{”} = d/d\tau,\ \tau = \omega_n t \\ M = \begin{bmatrix} 1 & 0 \\ 0 & \alpha \end{bmatrix},\ K\begin{bmatrix} 1+\gamma & -\gamma \\ -\beta\gamma & 1+\beta\gamma \end{bmatrix},\ x = \begin{bmatrix} u \\ v \end{bmatrix} \\ u = \frac{x}{L},\ v = \frac{a}{L}\theta,\ \omega_n = \sqrt{\frac{K}{M}},\ \alpha = \frac{J}{ML^2}(>0) \\ \beta = \frac{a}{L}\left(\frac{a}{L} - \mu\frac{b}{L}\right),\ \gamma = \frac{k_c}{K}(>0) \end{aligned}\right\} \tag{2}$$

A mass matrix and a stiffness matrix have asymmetry. In this case, the following is mathematically derived as described in Non Patent Literature 1. Specifically, when a value of α and a value of β do not satisfy conditions of Expression (3), a vibration amplitude of the guide shoe 100 increases.

[Math. 3]

$$\left.\begin{array}{c}\dfrac{-1+\alpha-\alpha\gamma+2\sqrt{\alpha(1-\alpha)\gamma}}{\gamma}<\beta(0<\alpha<1)\\ -\dfrac{1+\gamma}{\gamma}<\beta<\dfrac{-1+\alpha-\alpha\gamma-2\sqrt{\alpha(1-\alpha\gamma}}{\gamma}\left(\dfrac{\gamma}{1+\gamma}<\alpha<1\right)\\ -\dfrac{1+\gamma}{\gamma}<\beta\ (1\leq\alpha)\end{array}\right\}\quad(3)$$

In the related-art guide shoe 100 illustrated in FIG. 5, the values of α and β do not satisfy the stabilization conditions described above. Hence, a significant increase in vibration amplitude occurs. Thus, as one of means for stabilizing the vibration, there is given means for setting a large value to α so as to satisfy Expression (4) for the structure of the related-art guide shoe 100.

[Math. 4]

$$1\leq\alpha \text{ provided that } -\frac{1+\gamma}{\gamma}<\beta \text{ is satisfied}\quad(4)$$

Similarly, there is given means for setting a small value to β within a range smaller than 0 to satisfy Expression (5) for the structure of the related-art guide shoe 100.

[Math. 5]

$$\beta<\frac{-1+\alpha-\alpha\gamma-2\sqrt{\alpha(1-\alpha)\gamma}}{\gamma}<0 \text{ provided that } -\frac{1+\gamma}{\gamma}<\beta \text{ and } \frac{\gamma}{1+\gamma}<\alpha \text{ are satisfied}\quad(5)$$

To increase the value of α for the related-art guide shoe 100, it is required that a value of a rotation radius J/M of the guide shoe 100 be increased. Specifically, the moment of inertia J about the center of gravity of the guide shoe 100 is required to be increased in a plane that is orthogonal to the sliding surface of the skirt guard and the sliding surface of the base portion 21 of the guide shoe 100 and extends along a sliding direction in which the base portion 21 is slid across the skirt guide. The center of gravity in this case corresponds to a center of gravity of the base portion 21.

Further, to reduce the value of β for the related-art guide shoe 100, it is required that the distance "b" from a contact point between the skirt guard and the base portion 21 to the center of gravity of the base portion 21 be increased. In the above-mentioned manner, a sliding state of the guide shoe 100 across the skirt guard 4 is stabilized to thereby suppress the generation of the sliding noise through the operations of the passenger conveyor for a long period of time.

In this embodiment, in the guide shoe 20A, the weights 22 are provided at such positions that a moment of inertia about a combined center of gravity of the base portion 21 and the weights 22 is larger than a moment of inertia about the center of gravity of the base portion 21 in the plane that is orthogonal to the sliding surface of the skirt guard 4 and the sliding surface of the base portion 21 and extends along the sliding direction in which the base portion 21 is slid across the skirt guard 4. Specifically, the guide shoe 20A includes the base portion 21 and the weights 22. The base portion 21 is to be slid across the skirt guard 4 provided along the moving direction of the plurality of steps 10 that are movably provided. The weights 22 are provided to the base portion 21, and are configured to increase a rotation radius of a pitching motion in the moving direction of the base portion 21. Thus, the sliding state of the guide shoe 20A across the skirt guard 4 can be stabilized, and thus the generation of the sliding noise of the guide shoe 20A, which may be caused by sliding across the skirt guard 4, can be further suppressed. The pitching motion is a rotational motion of the base portion 21, which occurs about the center of gravity in the plane that is orthogonal to the sliding surface of the skirt guard 4 and the sliding surface of the base portion 21 and extends along the sliding direction of the base portion 21 across the skirt guard 4.

A combined center of gravity corresponds to a center of gravity when the weights are mounted to the base portion and the base portion and the weights are regarded as one integral body.

In the first embodiment described above, the weights 22 may be mounted to the base portion 21 in a state of being in contact only with the base portion 21. The guide shoe 20A may be mounted to the connector 15 in such a manner that a clearance is defined between the weights 22 and the components of the step 10. However, the weights 22 may be in contact not only with the base portion 21 but also with the components of the guide shoe 20A other than the base portion 21, for example, the leg portions 23 as long as a clearance is defined between the weights 22 and the components of the step 10. Also in other embodiments, the weights may be in contact not only with the base portion but also with the components of the guide shoe other than the base portion, for example, the leg portions as long as a clearance is defined between the weights and the components of the step.

In the first embodiment described above, the weights 22 containing a material having a specific gravity larger than that of a material of the base portion are provided to the base portion 21 to be located at such positions that a moment of inertia about a combined center of gravity of the base portion 21 and the weights 22 is larger than the moment of inertia about the center of gravity of the base portion 21. As a result, the vibration of the base portion 21 can be further reliably suppressed.

In each of first to eighteenth embodiments, description is given of a configuration in which a mass of the guide shoe is increased. Further, in each of the first to thirteenth embodiments, description is given of a configuration in which the value of α is increased, specifically, the moment of inertia about the combined center of gravity of the base portion and the weights in a case in which the weights are provided to the base portion is larger than the moment of inertia about the center of gravity of the base portion in the plane that is orthogonal to the sliding surface of the skirt guard and the sliding surface of the base portion and extends along the sliding direction of the base portion across the skirt guard. In each of the fourteenth to eighteenth embodiments, description is given of a configuration in which the value of β is reduced, specifically, the distance "b" from the contact point between the skirt guard and the base portion to the combined center of gravity of the base portion and the weights in a case in which the weights are provided to the base portion is larger than the distance "b" from the contact point between the skirt guard and the base portion to the center of gravity of the base portion.

Second Embodiment

Figure 7:
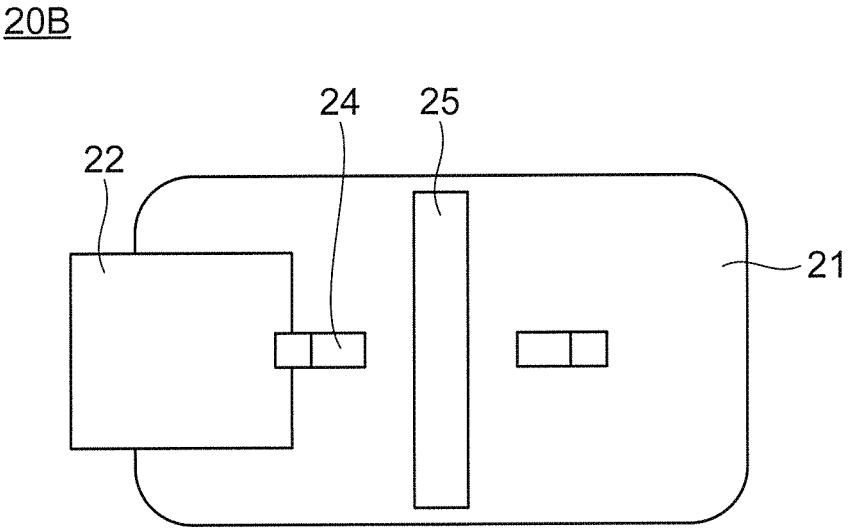
FIG. 7 is a top view of a guide shoe according to a second embodiment of this invention, which is to be mounted to a step of the passenger conveyor.
Figure 8:
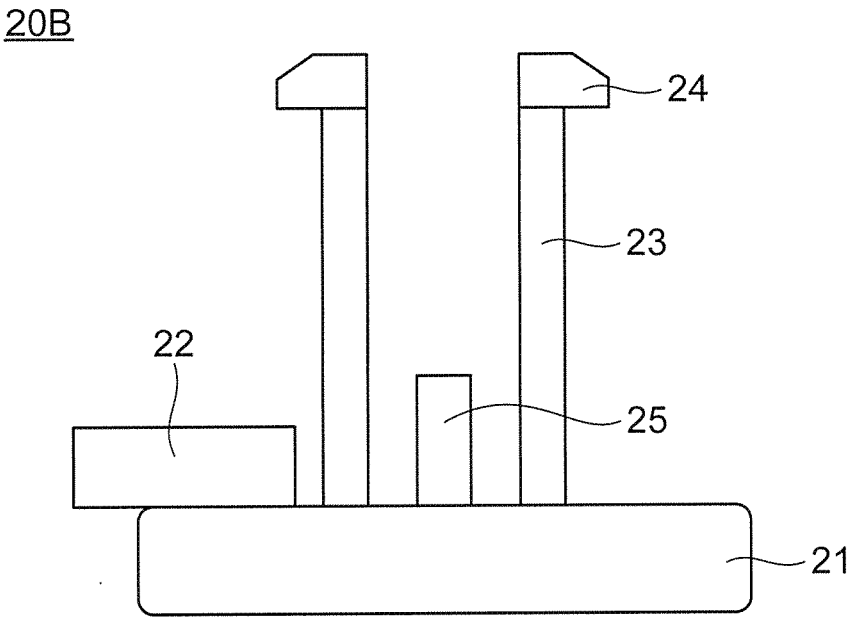
FIG. 8 is a side view of the guide shoe according to the second embodiment of this invention, which is to be mounted to a step of the passenger conveyor.

FIG. 7 is a top view of a guide shoe according to a second embodiment of this invention, which is to be mounted to a step of the passenger conveyor. FIG. 8 is a side view of the guide shoe according to the second embodiment of this invention, which is to be mounted to a step of the passenger conveyor.

In FIG. 7 and FIG. 8, one weight 22 is fixed to the back surface of the base portion 21 by, for example, bonding or welding in a state of being in contact with the base portion 21.

Other configurations are the same as those of the guide shoe in the first embodiment described above.

Also in a guide shoe 20B according to the second embodiment, the weight 22 made of a material having a specific gravity larger than that of a material of the base portion 21 is provided to the back surface of the base portion 21 in a state of being in contact with the base portion 21. Further, the weight 22 is provided at such a position that, when the weight 22 is provided to the base portion 21, the moment of inertia about a combined center of gravity of the base portion 21 and the weight 22 is larger than the moment of inertia about the center of gravity of the base portion 21. Further, the guide shoe 20B may also be mounted to the connector 15 in such a manner that the weight 22 is separate from the skirt guard 4. In this case, the weight 22 may be arranged without being in contact with the connector 15 or the components of the step 10, or may be arranged apart therefrom.

Thus, also in the second embodiment, the same effects as those obtained in the first embodiment described above are obtained.

Third Embodiment

Figure 9:
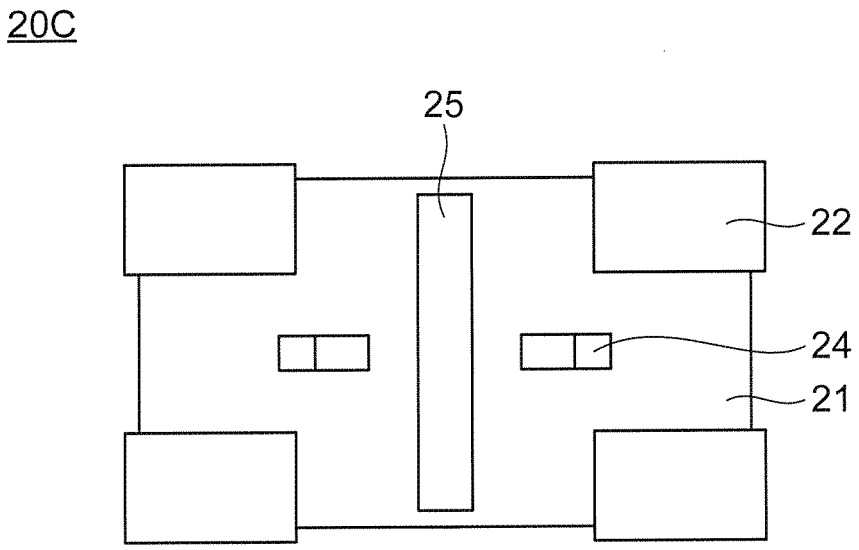
FIG. 9 is a top view of a guide shoe according to a third embodiment of this invention, which is to be mounted to a step of the passenger conveyor.
Figure 10:
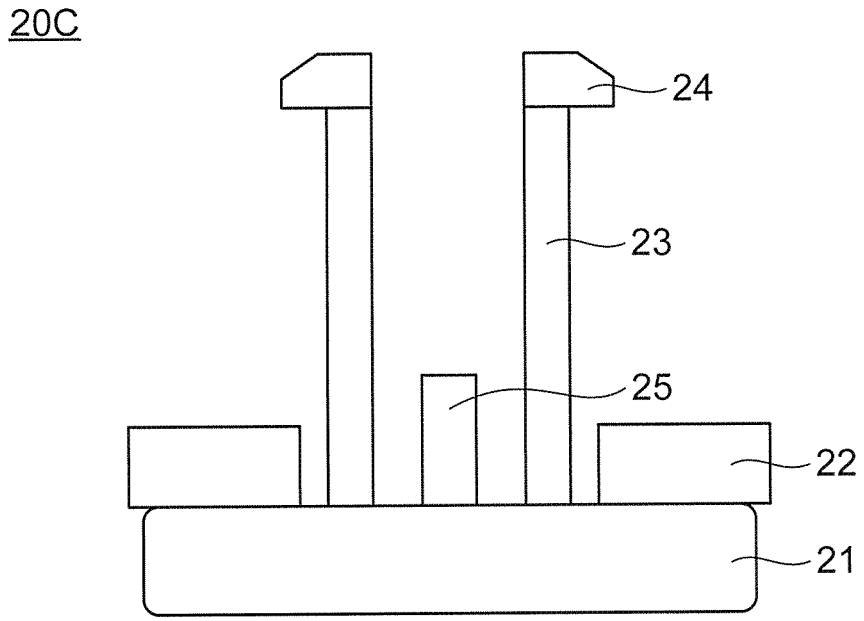
FIG. 10 is a side view of the guide shoe according to the third embodiment of this invention, which is to be mounted to a step of the passenger conveyor.

FIG. 9 is a top view of a guide shoe according to a third embodiment of this invention, which is to be mounted to a step of the passenger conveyor. FIG. 10 is a side view of the guide shoe according to the third embodiment of this invention, which is to be mounted to a step of the passenger conveyor.

In FIG. 9 and FIG. 10, the weights 22 are fixed to four corners of the rectangular back surface of the base portion 21 by, for example, bonding or welding, in a state of being in contact with the base portion 21.

Other configurations are the same as those of the guide shoe in the first embodiment described above.

Also in a guide shoe 20C according to the third embodiment, the weights 22 made of a material having a specific gravity larger than that of a material of the base portion 21 are provided to the back surface of the base portion 21 so as to be in contact with the base portion 21. Further, the weights 22 are provided at such positions that, when the weights 22 are provided to the base portion 21, the moment of inertia about a combined center of gravity of the base portion 21 and the weights is larger than the moment of inertia about the center of gravity of the base portion 21. Further, the guide shoe 20C is mounted to the connector 15 in such a manner that the weights 22 are separate from the skirt guard 4. In this case, the weights 22 may be arranged without being in contact with the connector 15 or the components of the step 10, or may be arranged apart therefrom.

Thus, also in the third embodiment, the same effects as those obtained in the first embodiment described above are obtained.

In the first to third embodiments, the numbers of weights 22 to be provided on the back surface of the base portion 21 are one, two, and four. However, the number of weights 22 to be provided on the back surface of the base portion 21 is only required to be equal to or larger than one, and the number thereof is not limited.

Fourth Embodiment

Figure 11:
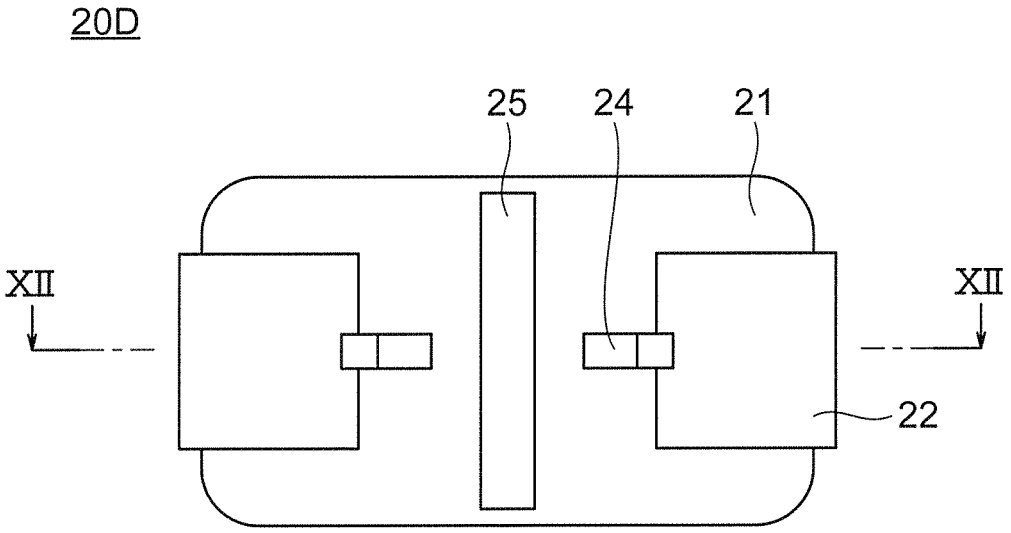
FIG. 11 is a top view of a guide shoe according to a fourth embodiment of this invention, which is to be mounted to a step of the passenger conveyor.
Figure 12:
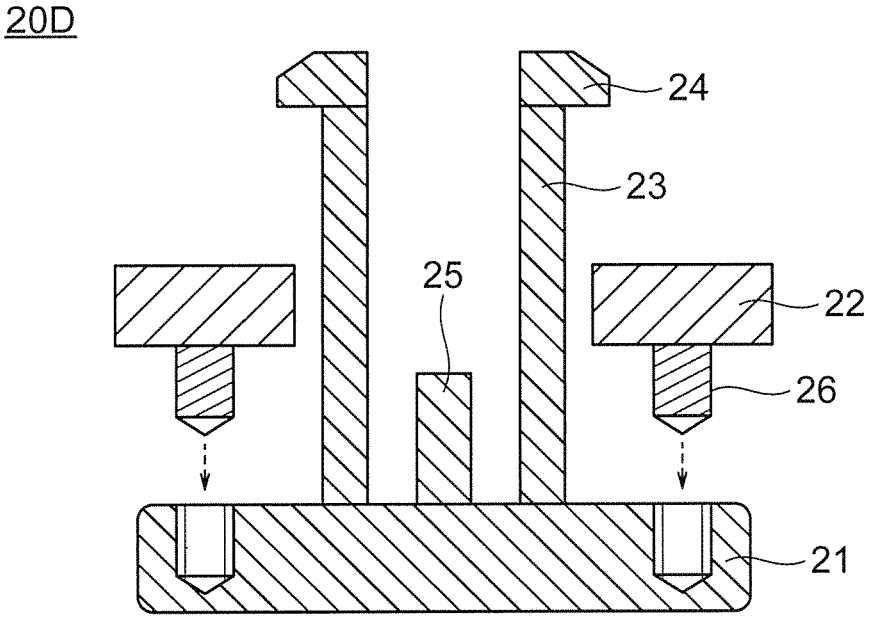
FIG. 12 is a sectional view taken along the line XII-XII in FIG. 11 when viewed in a direction of arrows.

FIG. 11 is a top view of a guide shoe according to a fourth embodiment of this invention, which is to be mounted to a step of the passenger conveyor. FIG. 12 is a sectional view taken along the line XII-XII in FIG. 11 when viewed in a direction of arrows.

In FIG. 11 and FIG. 12, the weights 22 are fixed to the back surface of the base portion 21 with screws 26 in a state of being in contact with the base portion 21.

Other configurations are the same as those of the guide shoe in the first embodiment described above.

Also in a guide shoe 20D according to the fourth embodiment, the weights 22 made of a material having a specific gravity larger than that of a material of the base portion 21 are provided to the back surface of the base portion 21 so as to be in contact with the base portion 21. Further, the weights 22 are provided at such positions that, when the weights 22 are provided to the base portion 21, the moment of inertia about a combined center of gravity of the base portion 21 and the weights is larger than the moment of inertia about the center of gravity of the base portion 21. Further, the guide shoe 20D is mounted to the connector 15 in such a manner that the weights 22 are separate from the skirt guard 4. In this case, the weights 22 may be arranged without being in contact with the connector 15 or the components of the step 10, or may be arranged apart therefrom.

Thus, also in the fourth embodiment, the same effects as those obtained in the first embodiment described above are obtained.

Fifth Embodiment

Figure 13:
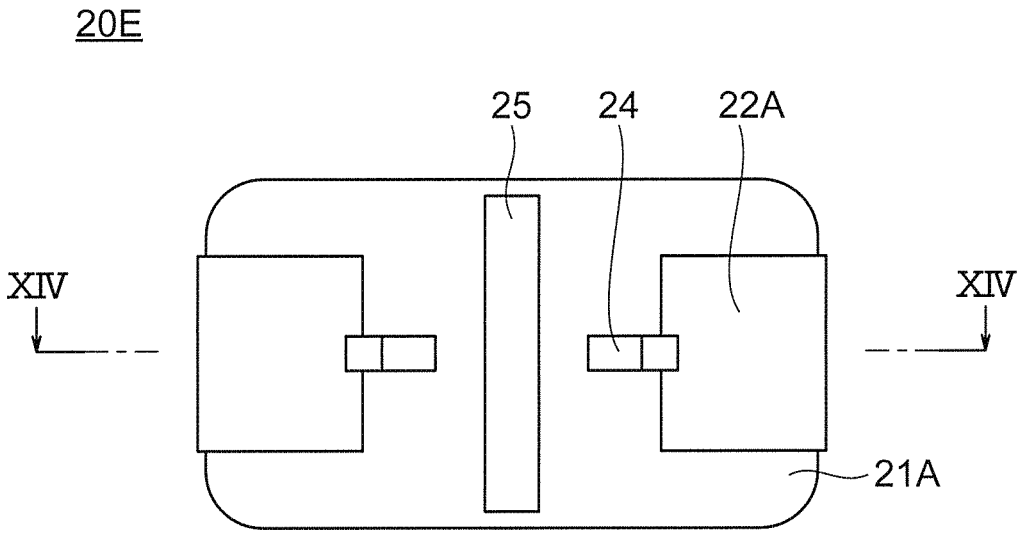
FIG. 13 is a top view of a guide shoe according to a fifth embodiment of this invention, which is to be mounted to a step of the passenger conveyor.
Figure 14:
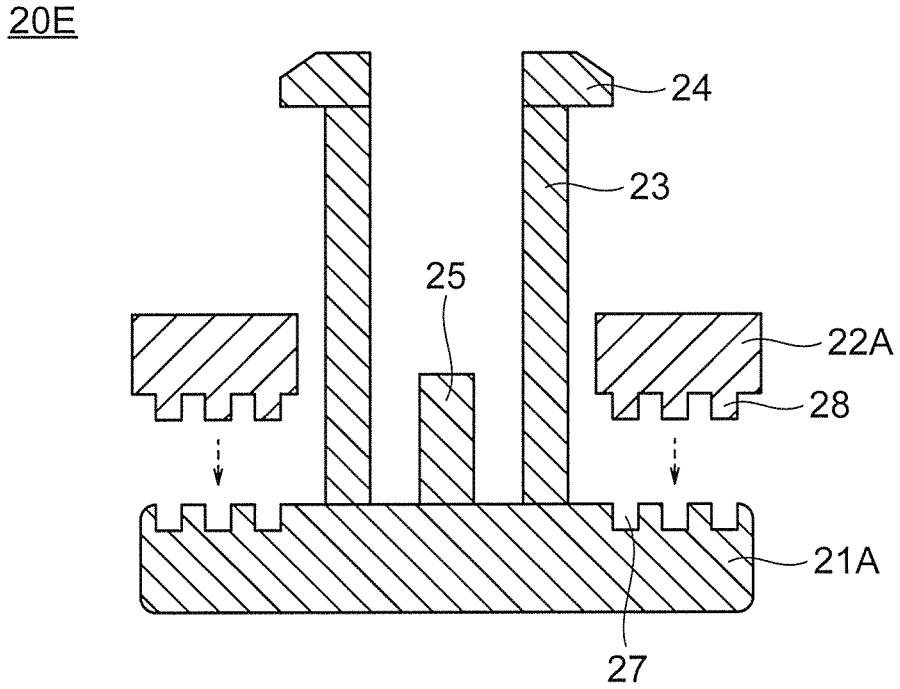
FIG. 14 is a sectional view taken along the line XIV-XIV in FIG. 13 when viewed in a direction of arrows.

FIG. 13 is a top view of a guide shoe according to a fifth embodiment of this invention, which is to be mounted to a step of the passenger conveyor. FIG. 14 is a sectional view taken along the line XIV-XIV in FIG. 13 when viewed in a direction of arrows.

In FIG. 13 and FIG. 14, similarly to the base portion 21, a base portion 21A is made of a low-friction material, and is formed in a flat rectangular parallelepiped shape. Fitting recessed portions 27 are formed in the back surface of the base portion 21A. Similarly to the weight 22, each of weights 22A is made of a material having a specific gravity larger than that of a material of the base portion 21A, and is formed in a rectangular parallelepiped shape. Fitting protruding portions 28 are formed on a bottom surface of each of the weights 22A. After the fitting protruding portions 28 are fitted into the fitting recessed portions 27, bonding therebetween is performed as needed. In this manner, the weights 22A are fixed to the base portion 21A.

Other configurations are the same as those of the guide shoe in the first embodiment described above.

Also in a guide shoe 20E according to the fifth embodiment, the weights 22A made of a material having a specific gravity larger than that of a material of the base portion 21A are provided to the back surface of the base portion 21A so as to be in contact with the base portion 21A. Further, the weights 22A are provided at such positions that, when the weights 22A are provided to the base portion 21A, a moment of inertia about a combined center of gravity of the base portion 21A and the weights 22A is larger than a moment of inertia about the center of gravity of the base portion 21A. Further, the guide shoe 20E is mounted to the connector 15 in such a manner that the weights 22A are separate from the skirt guard 4. In this case, the weights 22A may be arranged without being in contact with the connector 15 or the components of the step 10, or may be arranged apart therefrom.

Thus, also in the fifth embodiment, the same effects as those obtained in the first embodiment described above are obtained.

Sixth Embodiment

Figure 15:
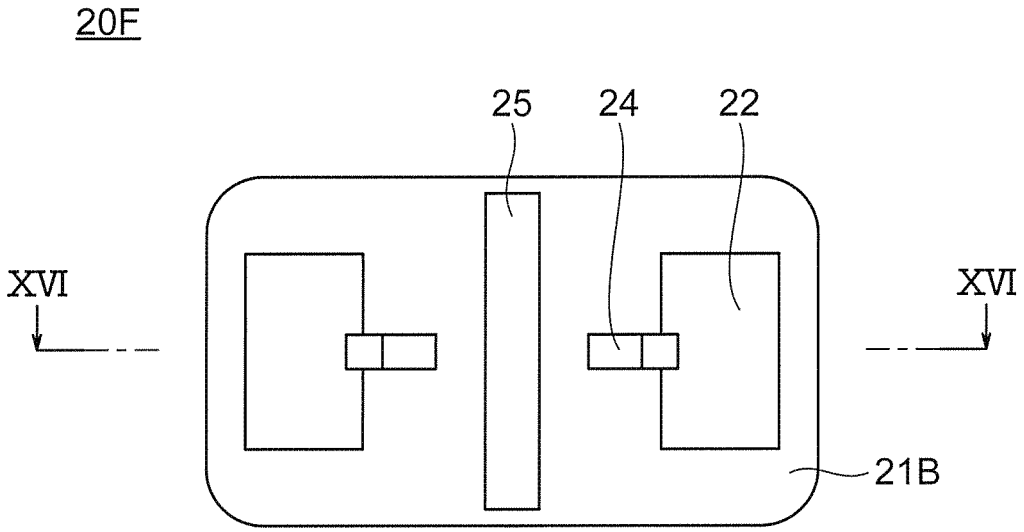
FIG. 15 is a top view of a guide shoe according to a sixth embodiment of this invention, which is to be mounted to a step of the passenger conveyor.
Figure 16:
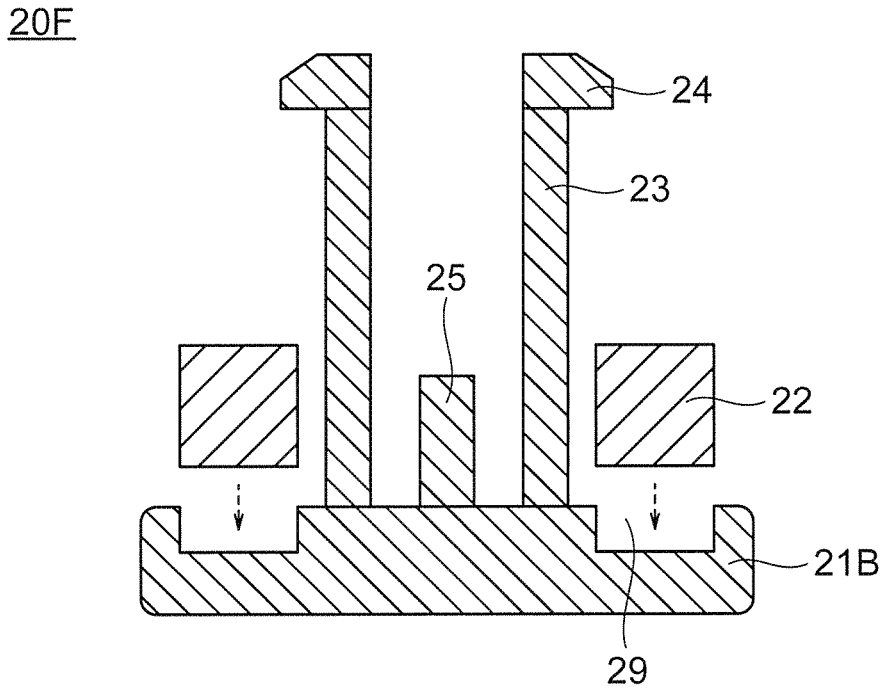
FIG. 16 is a sectional view taken along the line XVI-XVI in FIG. 15 when viewed in a direction of arrows.

FIG. 15 is a top view of a guide shoe according to a sixth embodiment of this invention, which is to be mounted to a step of the passenger conveyor. FIG. 16 is a sectional view taken along the line XVI-XVI in FIG. 15 when viewed in a direction of arrows.

In FIG. 15 and FIG. 16, similarly to the base portion 21, a base portion 21B is made of a low-friction material, and is formed in a flat rectangular parallelepiped shape. Fitting recessed portions 29 are formed in the back surface of the base portion 21B. After the weights 22 are fitted into the fitting recessed portions 29, bonding therebetween is performed as needed. In this manner, the weights 22 are fixed to the base portion 21B.

Other configurations are the same as those of the guide shoe in the first embodiment described above.

Also in a guide shoe 20F according to the sixth embodiment, the weights 22 made of a material having a specific gravity larger than that of a material of the base portion 21B are provided to the back surface of the base portion 21B so as to be in contact with the base portion 21B. Further, the weights 22 are provided at such positions that, when the weights 22 are provided to the base portion 21B, a moment of inertia about a combined center of gravity of the base portion 21B and the weights 22 is larger than a moment of inertia about the center of gravity of the base portion 21B. Further, the guide shoe 20F is mounted to the connector 15 in such a manner that the weights are separate from the skirt guard 4. In this case, the weights 22 may be arranged without being in contact with the connector 15 or the components of the step 10, or may be arranged apart therefrom.

Thus, also in the sixth embodiment, the same effects as those obtained in the first embodiment described above are obtained.

In the first to sixth embodiments described above, the weight is fixed to the base portion by, for example, integral molding, bonding, welding, screws, or fitting between the recessed portions and the protruding portions. However, fixing means is not limited to the means described above. The weight may be fixed to the base portion with use of a tape, a wire, or a rope. Further, when the weight is made of a magnetic material, the weight may be fixed to the base portion with use of a magnet.

Seventh Embodiment

Figure 17:
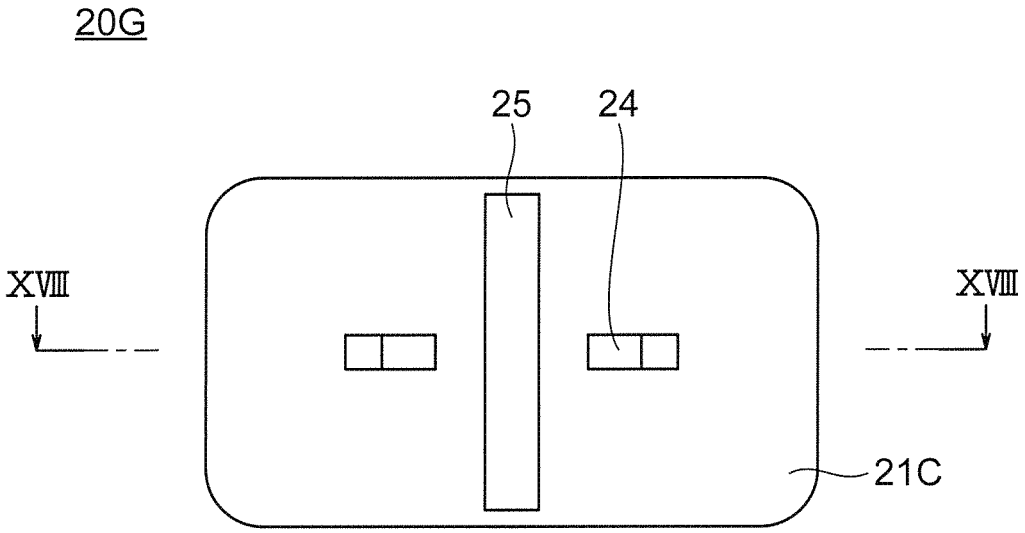
FIG. 17 is a top view of a guide shoe according to a seventh embodiment of this invention, which is to be mounted to a step of the passenger conveyor.
Figure 18:
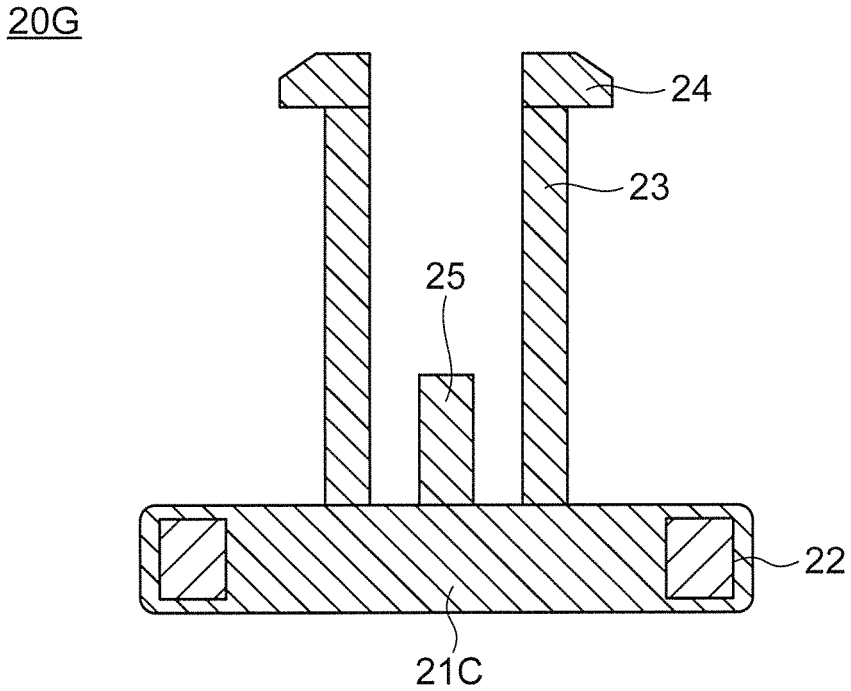
FIG. 18 is a sectional view taken along the line XVIII-XVIII in FIG. 17 when viewed in a direction of arrows.

FIG. 17 is a top view of a guide shoe according to a seventh embodiment of this invention, which is to be mounted to a step of the passenger conveyor. FIG. 18 is a sectional view taken along the line XVIII-XVIII in FIG. 17 when viewed in a direction of arrows.

In FIG. 17 and FIG. 18, similarly to the base portion 21, a base portion 21C is made of a low-friction material, and is formed in a flat rectangular parallelepiped shape. The weights 22 are embedded in the base portion 21C by insert molding into the base portion 21C.

Other configurations are the same as those of the guide shoe in the first embodiment described above.

Also in a guide shoe 20G according to the seventh embodiment, the weights 22 made of a material having a specific gravity larger than that of a material of the base portion 21C are provided in the base portion 21C in an embedded manner. Further, the weights 22 are provided at such positions that, when the weights 22 are provided to the base portion 21C, a moment of inertia about a combined center of gravity of the base portion 21C and the weights 22 is larger than a moment of inertia about the center of gravity of the base portion 21C. Further, the guide shoe 20G is mounted to the connector 15 in such a manner that the weights 22 are separate from the skirt guard 4. In this case, the weights 22 may be arranged without being in contact with the connector 15 or the components of the step 10, or may be arranged apart therefrom.

Thus, also in the seventh embodiment, the same effects as those obtained in the first embodiment described above are obtained.

According to the seventh embodiment, the weights 22 are embedded in the base portion 21C. With this arrangement, occurrence of defective mounting of the weights 22 at a time of manufacture of the guide shoe 20G can be prevented. Further, even when an external force acts on the weights 22 at a time of mounting of the guide shoe 20G and at a time of operation of the passage conveyor, separation and detachment of the weights 22G from the base portion 21C can be prevented.

Eighth Embodiment

Figure 19:
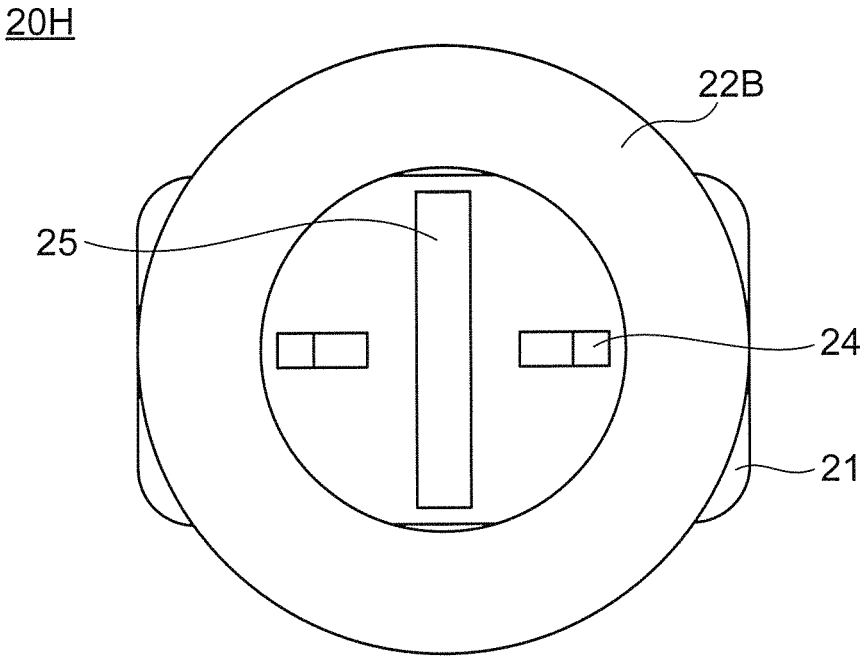
FIG. 19 is a top view of a guide shoe according to an eighth embodiment of this invention, which is to be mounted to a step of the passenger conveyor.
Figure 20:
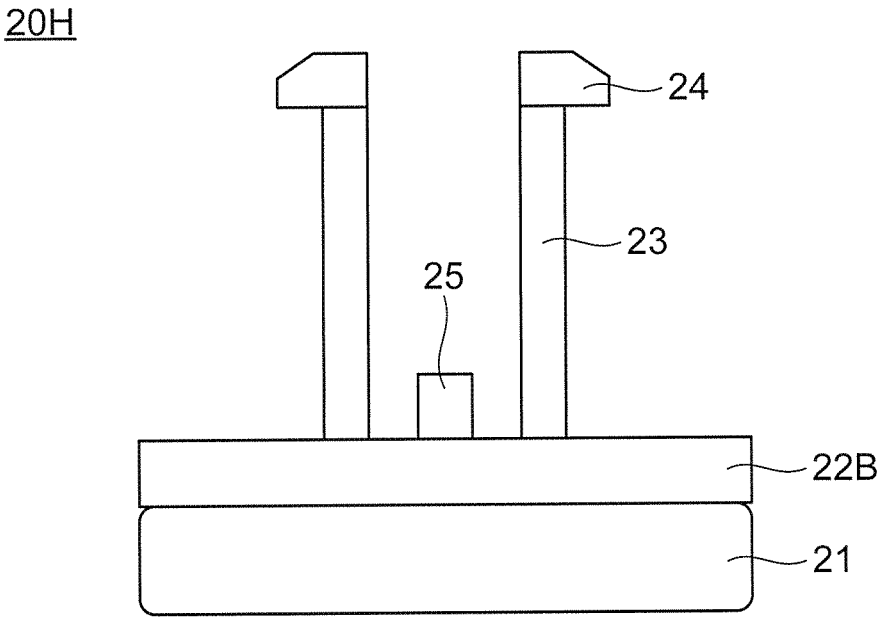
FIG. 20 is a side view of the guide shoe according to the eighth embodiment of this invention, which is to be mounted to a step of the passenger conveyor.

FIG. 19 is a top view of a guide shoe according to an eighth embodiment of this invention, which is to be mounted to a step of the passenger conveyor. FIG. 20 is a side view of the guide shoe according to the eighth embodiment of this invention, which is to be mounted to a step of the passenger conveyor.

In FIG. 19 and FIG. 20, a weight 22B is made of a material having a specific gravity larger than that of a material of the base portion 21, and is formed in a flat ring-like shape. The weight 22B is fixed to the back surface of the base portion 21 by, for example, bonding or welding in such a manner as to surround the pair of leg portions 23 and the protruding portion 25 without being in contact with the pair of leg portions 23 and the protruding portion 25.

Other configurations are the same as those of the guide shoe in the first embodiment described above.

Also in a guide shoe 20H according to the eighth embodiment, the weight 22B made of a material having a specific gravity larger than that of a material of the base portion 21 is provided to the back surface of the base portion 21 so as to be in contact with the base portion 21. Further, the weight 22B is provided at such a position that, when the weight 22B is provided to the base portion 21, the moment of inertia about a combined center of gravity of the base portion 21 and the weight 22B is larger than the moment of inertia about the center of gravity of the base portion 21. Further, the guide shoe 20H is mounted to the connector 15 in such a manner that the weight 22B is separate from the skirt guard 4. In this case, the weight 22B may be arranged without being in contact with the connector 15 or the components of the step 10, or may be arranged apart therefrom.

Thus, also in the eighth embodiment, the same effects as those obtained in the first embodiment described above are obtained.

According to the eighth embodiment, the weight 22B is formed in a flat ring-like shape. With this shape, even when the weight 22B comes off the base portion 21 during operation of the passenger conveyor, falling of the weight 22B into the passenger conveyor is prevented.

Ninth Embodiment

Figure 21:
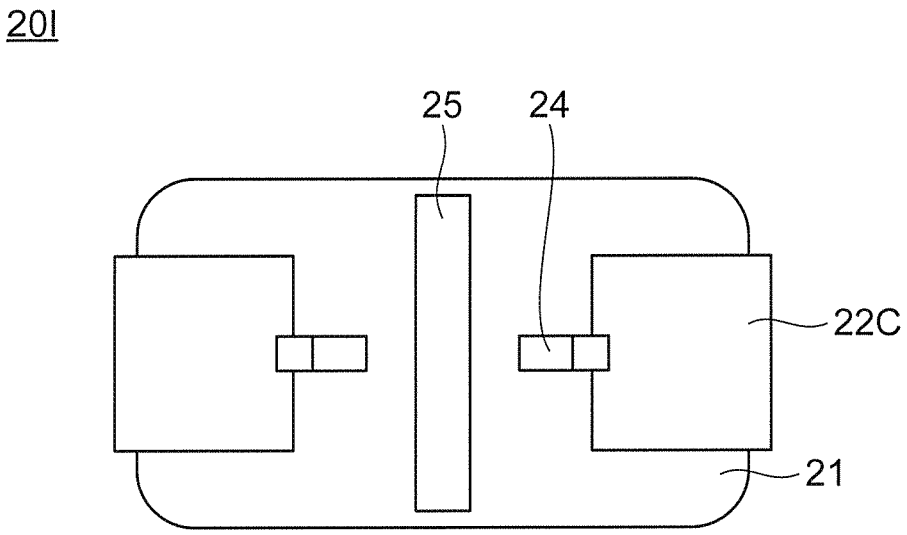
FIG. 21 is a top view of a guide shoe according to a ninth embodiment of this invention, which is to be mounted to a step of the passenger conveyor.
Figure 22:
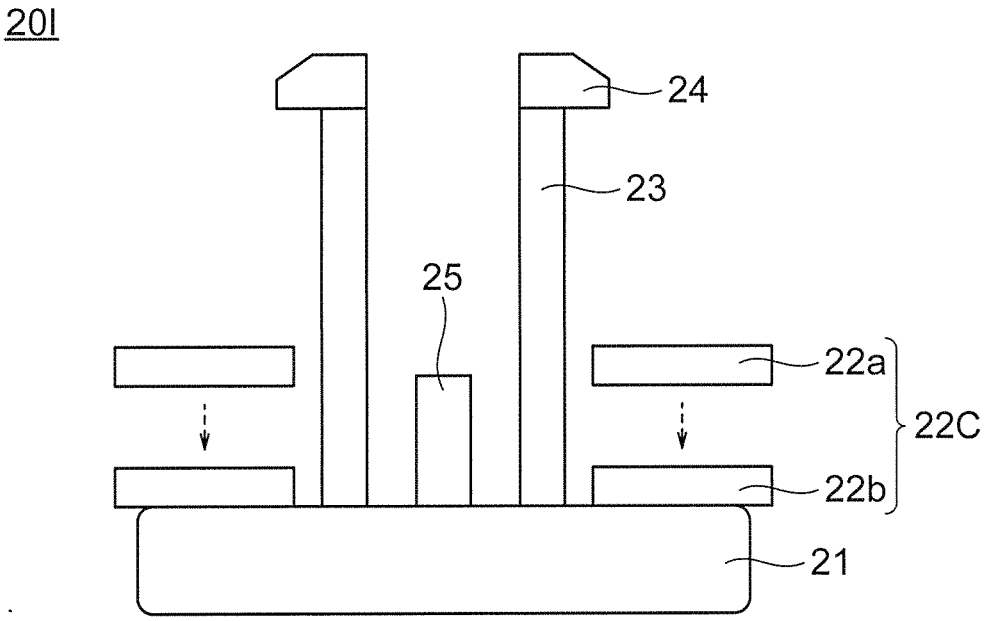
FIG. 22 is a side view of the guide shoe according to the ninth embodiment of this invention, which is to be mounted to a step of the passenger conveyor.

FIG. 21 is a top view of a guide shoe according to a ninth embodiment of this invention, which is to be mounted to a step of the passenger conveyor. FIG. 22 is a side view of the guide shoe according to the ninth embodiment of this invention, which is to be mounted to a step of the passenger conveyor.

In FIG. 21 and FIG. 22, each of weights 22C is formed by laminating and integrating weight pieces 22*a* and 22*b* through, for example, bonding or welding. The weight pieces 22*a* and 22*b* are made of a material having a specific gravity larger than that of a material of the base portion 21, and are each formed in a flat rectangular parallelepiped shape. A weight of the weights 22C is the same as that of the weights 22. The weights 22C are fixed to the back surface of the base portion 21 by bonding or welding in a state of being in contact with the base portion 21.

Other configurations are the same as those of the guide shoe in the first embodiment described above.

Also in a guide shoe 201 according to the ninth embodiment, the weights 22C made of a material having a specific gravity larger than that of a material of the base portion 21 are provided to the back surface of the base portion 21 so as to be in contact with the base portion 21. Further, the weights 22C are provided at such positions that, when the weights 22C are provided to the base portion 21, the moment of inertia about a combined center of gravity of the base portion 21 and the weights 22C is larger than the moment of inertia about the center of gravity of the base portion 21. Further, the guide shoe 201 is mounted to the connector 15 in such a manner that the weights 22C are separate from the skirt guard 4. In this case, the weights 22C may be arranged without being in contact with the connector 15 or the components of the step 10, or may be arranged apart therefrom.

Thus, also in the ninth embodiment, the same effects as those obtained in the first embodiment described above are obtained.

In the ninth embodiment, two weight pieces 22*a* and 22*b* are fixed by bonding or welding. A method of fixing the weight pieces 22*a* and 22*b* is not limited to bonding or welding. Further, each of the weights 221 is divided into two weight pieces 22*a* and 22*b*. However, the number of division of the weight is not limited to two.

Tenth Embodiment

Figure 23:
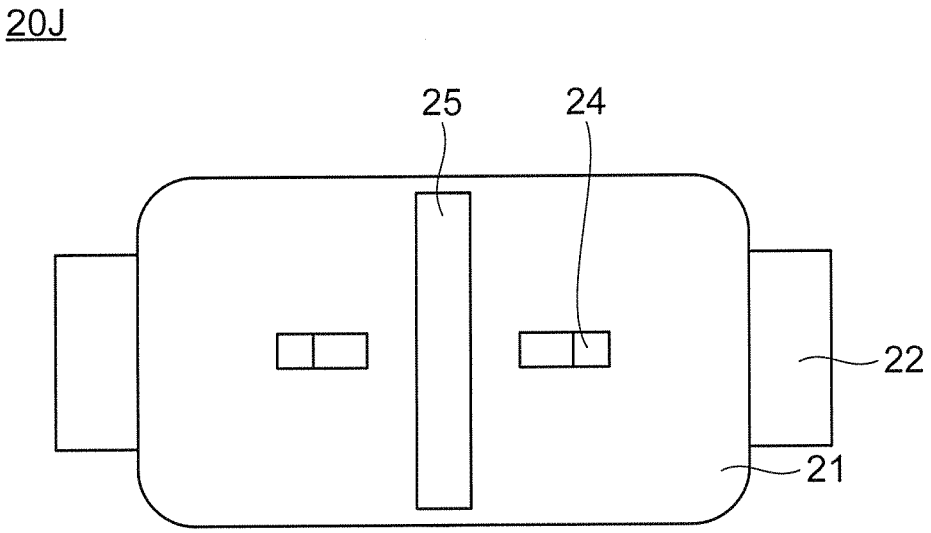
FIG. 23 is a top view of a guide shoe according to a tenth embodiment of this invention, which is to be mounted to a step of the passenger conveyor.
Figure 24:
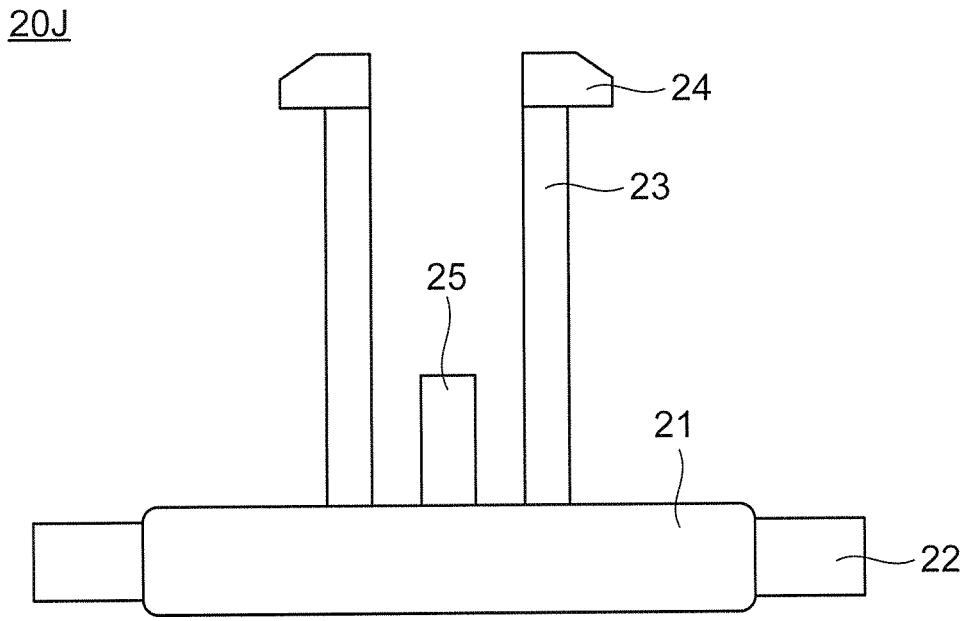
FIG. 24 is a side view of the guide shoe according to the tenth embodiment of this invention, which is to be mounted to a step of the passenger conveyor.

FIG. 23 is a top view of a guide shoe according to a tenth embodiment of this invention, which is to be mounted to a step of the passenger conveyor. FIG. 24 is a side view of the guide shoe according to the tenth embodiment of this invention, which is to be mounted to a step of the passenger conveyor.

In FIG. 23 and FIG. 24, the weights 22 are fixed to a pair of side surfaces of the base portion 21, which are opposed to each other, by, for example, bonding or welding. In this case, the side surfaces are orthogonal to the sliding surface of the base portion 21 formed in a flat rectangular parallelepiped shape.

Other configurations are the same as those of the guide shoe in the first embodiment described above.

Also in a guide shoe 20J according to the tenth embodiment, the weights 22 made of a material having a specific gravity larger than that of a material of the base portion 21 are provided to the pair of side surfaces of the base portion 21 so as to be in contact with the base portion 21. Further, the weights 22 are provided at such positions that, when the weights 22 are provided to the base portion 21, the moment of inertia about a combined center of gravity of the base portion 21 and the weights 22 is larger than the moment of inertia about the center of gravity of the base portion 21. Further, the guide shoe 201 may also be mounted to the connector 15 in such a manner that the weights 22 are separate from the skirt guard 4. Specifically, the weights 22 may be in contact with the base portion 21, and may be separate from components of the step 10, such as the step tread 11, the riser 12, the triangular bracket 13, and the connector 15, and the skirt guard 4.

Thus, also in the tenth embodiment, the same effects as those obtained in the first embodiment described above are obtained.

Eleventh Embodiment

Figure 25:
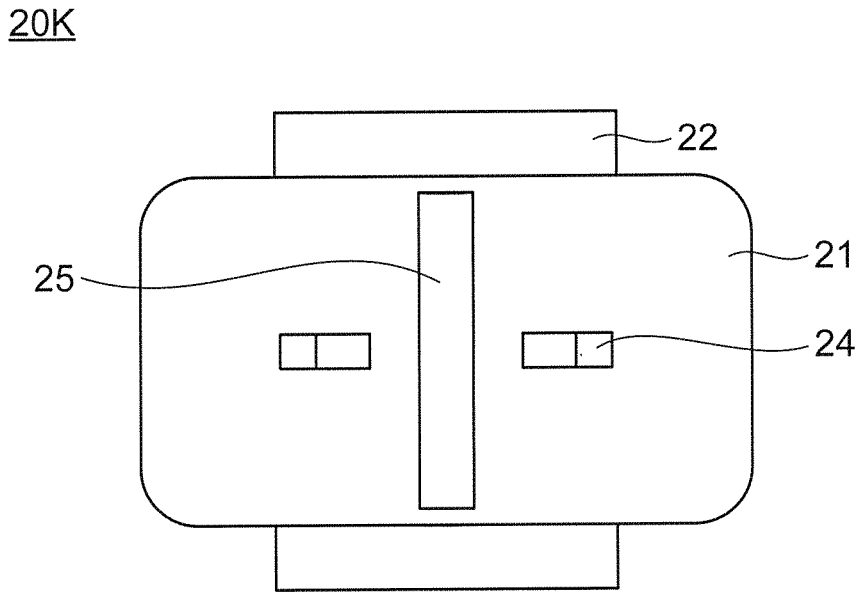
FIG. 25 is a top view of a guide shoe according to an eleventh embodiment of this invention, which is to be mounted to a step of the passenger conveyor.
Figure 26:
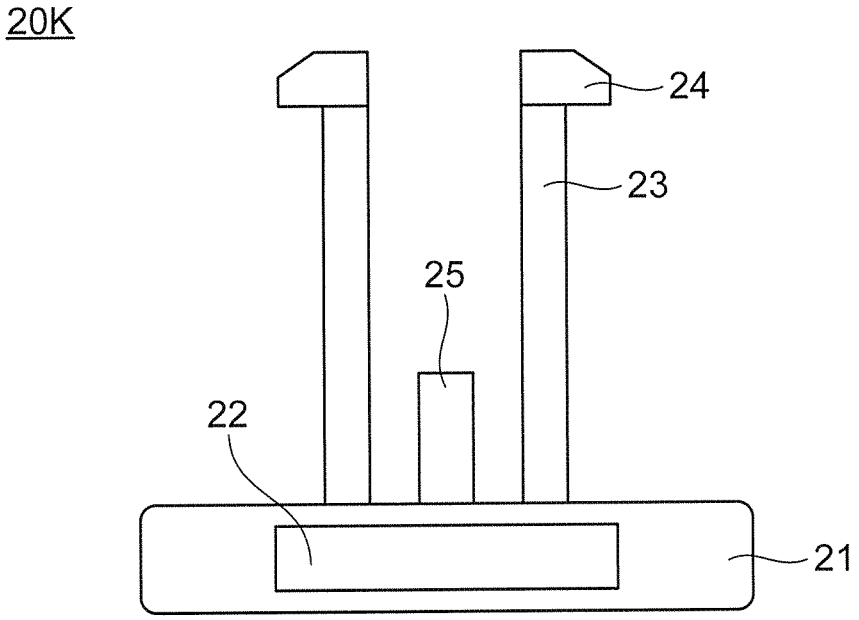
FIG. 26 is a side view of the guide shoe according to the eleventh embodiment of this invention, which is to be mounted to a step of the passenger conveyor.

FIG. 25 is a top view of a guide shoe according to an eleventh embodiment of this invention, which is to be mounted to a step of the passenger conveyor. FIG. 26 is a side view of the guide shoe according to the eleventh embodiment of this invention, which is to be mounted to a step of the passenger conveyor.

In FIG. 25 and FIG. 26, the weights 22 are fixed to the other pair of side surfaces of the base portion 21, which are opposed to each other, by, for example, bonding or welding.

Other configurations are the same as those of the guide shoe in the tenth embodiment described above.

Also in a guide shoe 20K according to the tenth embodiment, the weights 22 made of a material having a specific gravity larger than that of a material of the base portion 21 are provided to the other pair of side surfaces of the base portion 21 so as to be in contact with the base portion 21. Further, the weights 22 are provided at such positions that, when the weights 22 are provided to the base portion 21, the moment of inertia about a combined center of gravity of the base portion 21 and the weights 22 is larger than the moment of inertia about the center of gravity of the base portion 21. Further, the guide shoe 20K is mounted to the connector 15 in such a manner that the weights 22 are separate from the skirt guard 4. In this case, the weights 22 may be arranged without being in contact with the connector 15 or the components of the step 10, or may be arranged apart therefrom.

Thus, also in the eleventh embodiment, the same effects as those obtained in the tenth embodiment described above are obtained.

Twelfth Embodiment

Figure 27:
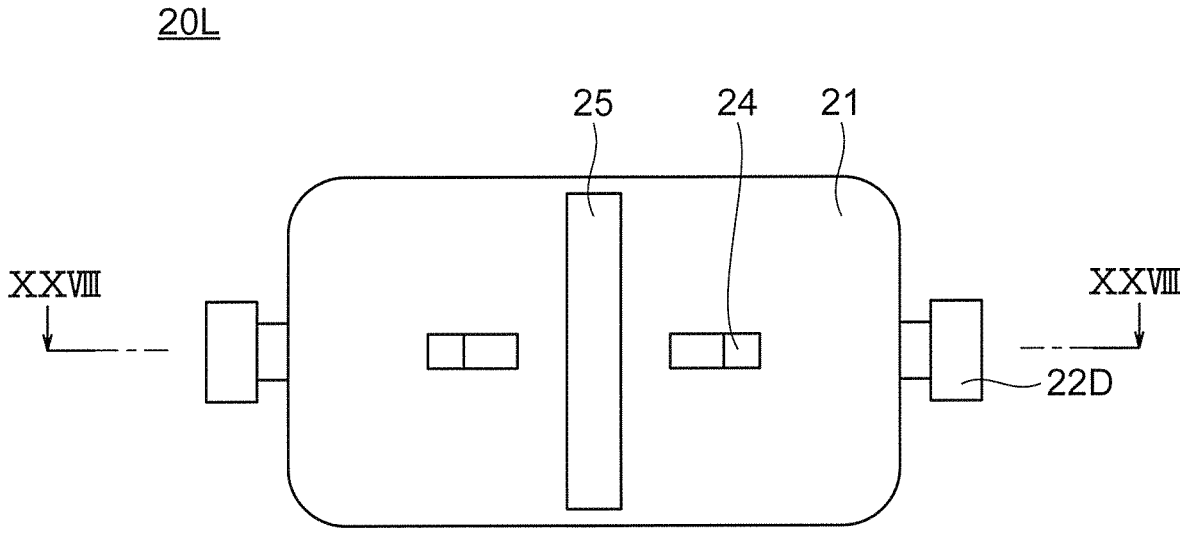
FIG. 27 is a top view of a guide shoe according to a twelfth embodiment of this invention, which is to be mounted to a step of the passenger conveyor.
Figure 28:
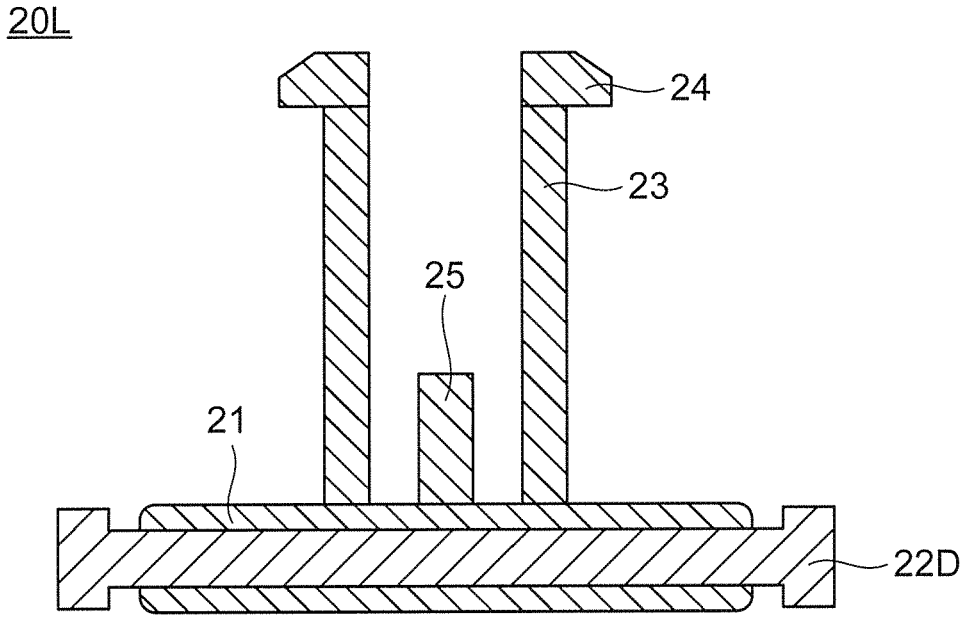
FIG. 28 is a sectional view taken along the line XXVIII-XXVIII in FIG. 27 when viewed in a direction of arrows.

FIG. 27 is a top view of a guide shoe according to a twelfth embodiment of this invention, which is to be mounted to a step of the passenger conveyor. FIG. 28 is a side view of the guide shoe according to the twelfth embodiment of this invention, which is to be mounted to a step of the passenger conveyor.

In FIG. 27 and FIG. 28, a weight 22D is made of a material having a specific gravity larger than that of a material of the base portion 21, and is formed in a rod-like shape. The weight 22D is provided in the base portion 21 by insert molding into the base portion 21.

Other configurations are the same as those of the guide shoe in the tenth embodiment described above.

Also in a guide shoe 20L according to the twelfth embodiment, the weight 22D made of a material having a specific gravity larger than that of a material of the base portion 21 is provided to the base portion 21 so as to be in contact with the base portion 21. Further, the weight 22D is provided at such a position that, when the weight 22D is provided to the base portion 21, a moment of inertia about a combined center of gravity of the base portion 21 and the weight 22D is larger than the moment of inertia about the center of gravity of the base portion 21. Further, the guide shoe 20L is mounted to the connector 15 in such a manner that the weight 22D is separate from the skirt guard 4. In this case, the weight 22D may be arranged without being in contact with the connector 15 or the components of the step 10, or may be arranged apart therefrom.

Thus, also in the twelfth embodiment, the same effects as those obtained in the tenth embodiment described above are obtained.

Thirteenth Embodiment

Figure 29:
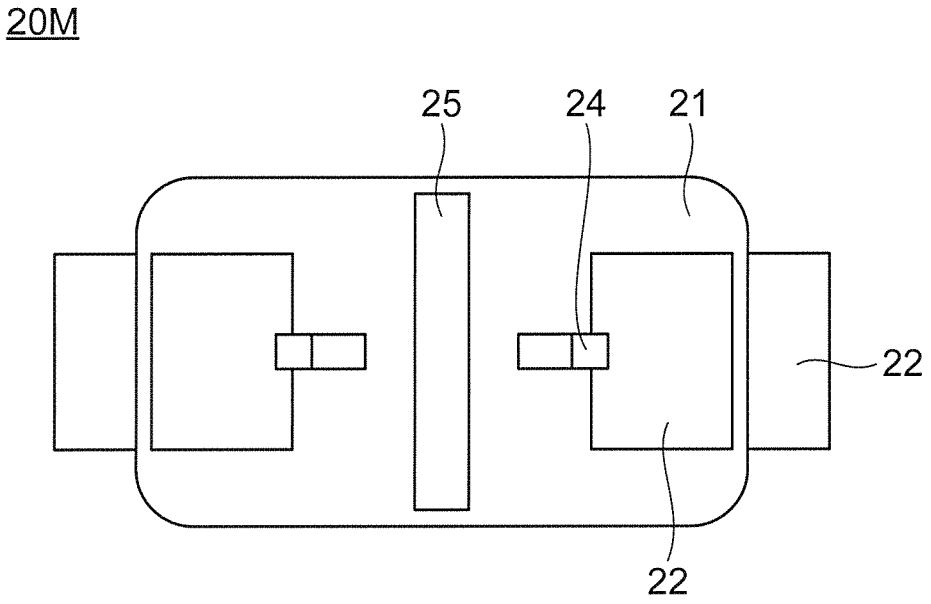
FIG. 29 is a top view of a guide shoe according to a thirteenth embodiment of this invention, which is to be mounted to a step of the passenger conveyor.
Figure 30:
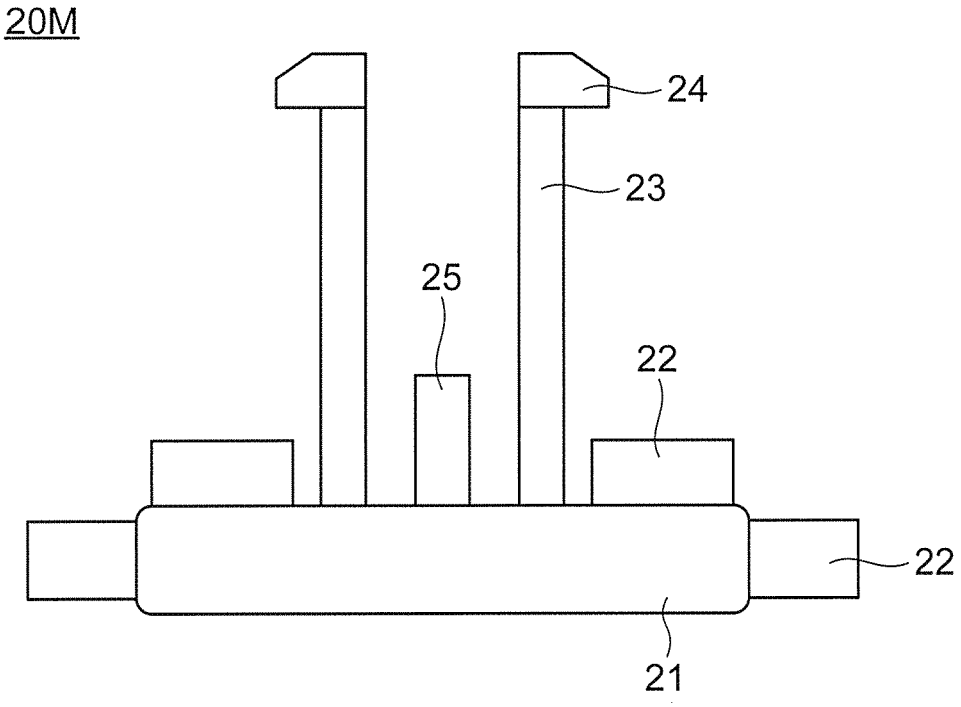
FIG. 30 is a side view of the guide shoe according to the thirteenth embodiment of this invention, which is to be mounted to a step of the passenger conveyor.

FIG. 29 is a top view of a guide shoe according to a thirteenth embodiment of this invention, which is to be mounted to a step of the passenger conveyor. FIG. 30 is a side view of the guide shoe according to the thirteenth embodiment of this invention, which is to be mounted to a step of the passenger conveyor.

In FIG. 29 and FIG. 30, the weights 22 are fixed in the vicinity of both end sides of the back surface and to the pair of opposed side surfaces of the base portion 21 on a one-by-one basis by, for example, bonding or welding.

Other configurations are the same as those of the guide shoe in the tenth embodiment described above.

Also in a guide shoe 20M according to the thirteenth embodiment, the weights 22 made of a material having a specific gravity larger than that of a material of the base portion 21 are provided to the base portion 21 so as to be in contact with the base portion 21. Further, the weights 22 are provided at such positions that, when the weights 22 are provided to the base portion 21, a moment of inertia about a combined center of gravity of the base portion and the weights is larger than the moment of inertia about the center of gravity of the base portion 21. Further, the guide shoe 20M is mounted to the connector 15 in such a manner that the weights 22 are separate from the skirt guard 4. In this case, the weights 22 may be arranged without being in contact with the connector 15 or the components of the step 10, or may be arranged apart therefrom.

Thus, also in the thirteenth embodiment, the same effects as those obtained in the tenth embodiment described above are obtained.

In the eighth to eleventh and thirteenth embodiments described above, the weight is fixed to the base portion by, for example, bonding or welding. However, fixing means is not limited to the means described above. The weight may be fixed to the base portion by screws, fitting between recessed portions and protruding portions, a tape, a wire, or a rope. Further, when the weight is made of a magnetic material, the weight may be fixed to the base portion with use of a magnet.

The inventors actually conducted an experiment. When the specific gravity of the weight was smaller than the specific gravity of the base portion, a sufficient vibration suppression effect was not obtained. Thus, it is preferred that the specific gravity of the weight be 1.2 or more times the specific gravity of the base portion. In each of the embodiments, it is preferred that a weight of the weight be 0.5 or more times that of the base portion. Further, a likelihood of the suppression of vibration increases as the specific gravity of the weight is increased with respect to the specific gravity of the base portion. In view of installation and maintenance workability, however, it is preferred that an upper-limit specific gravity of the weight be 25 or less times the specific gravity of the base portion.

Further, in the first to sixth and eighth to thirteenth embodiments described above, the weights 22 are made of a material having a specific gravity larger than that of a material of the base portion 21.

To suppress the vibration of the guide shoe, it is effective to set the value of $\beta$ small so as to satisfy Expression (5). In the fourteenth to eighteenth embodiments, when a weight 30 is provided to the related-art guide shoe 100, the generation of the sliding noise can be suppressed. Specifically, when the weight 30 is provided to the base portion 21, the value of $\beta$ can be reduced not only by an increase in mass of each of guide shoes ON to 20R but also by achievement of a large distance "b" from the contact point between the skirt guard 4 and the base portion 21 to the combined center of gravity of the base portion 21 and the weight 30. Thus, a sliding state of the guide shoes 20N to 20R across the skirt guard 4 can be stabilized. As a result, the generation of the sliding noise by each of the guide shoes 20N to 20R can be suppressed through operations of the passenger conveyor for a long period of time. A distance from the contact point between the base portion 21 and the skirt guard 4 to the center of gravity of the base portion 21 is referred to as "gravity-center distance".

Fourteenth Embodiment

Figure 31:
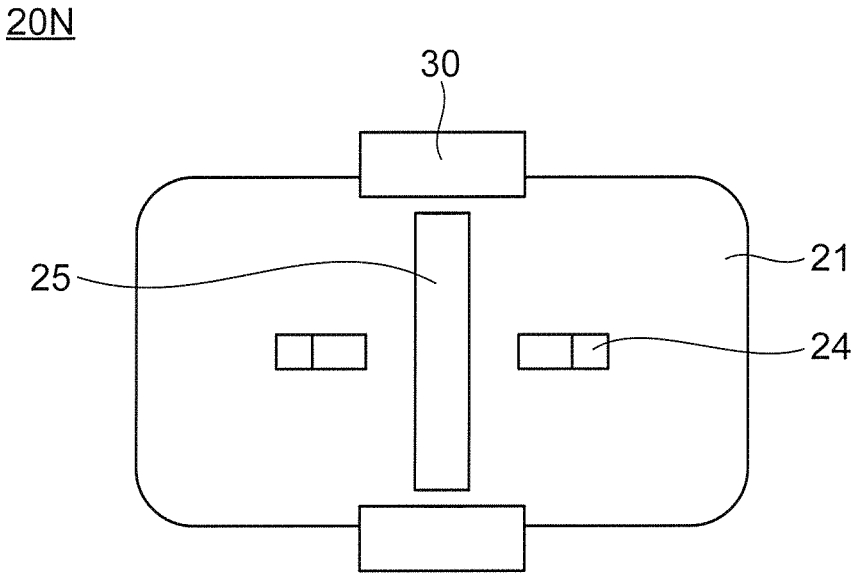
FIG. 31 is a top view of a guide shoe according to a fourteenth embodiment of this invention, which is to be mounted to a step of the passenger conveyor.
Figure 32:
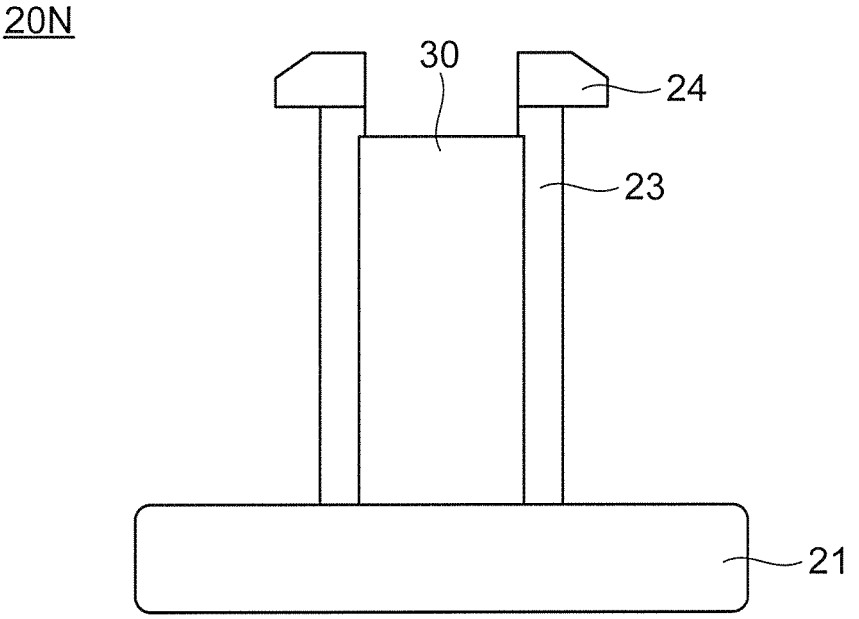
FIG. 32 is a side view of the guide shoe according to the fourteenth embodiment of this invention, which is to be mounted to a step of the passenger conveyor.

FIG. 31 is a top view of the guide shoe 20N according to the fourteenth embodiment of this invention. FIG. 32 is a side view of the guide shoe 20N according to the fourteenth embodiment of this invention. As illustrated in FIG. 31, the guide shoe 20N in this embodiment is formed to have the same configurations as those of the guide shoe 20 described in the first to thirteenth embodiments except that weights 30 are provided.

A pair of weights 30 are provided on the back surface of the base portion 21 in such a manner as to protrude toward the connector 15. A position of a combined center of gravity when the base portion 21 and the weights 30 are regarded as an integrated body is farther from the skirt guard than a position of the center of gravity of the base portion 21 alone. Specifically, a larger gravity-center distance than that in the related-art guide shoe 100 is ensured.

Fifteenth Embodiment

Figure 33:
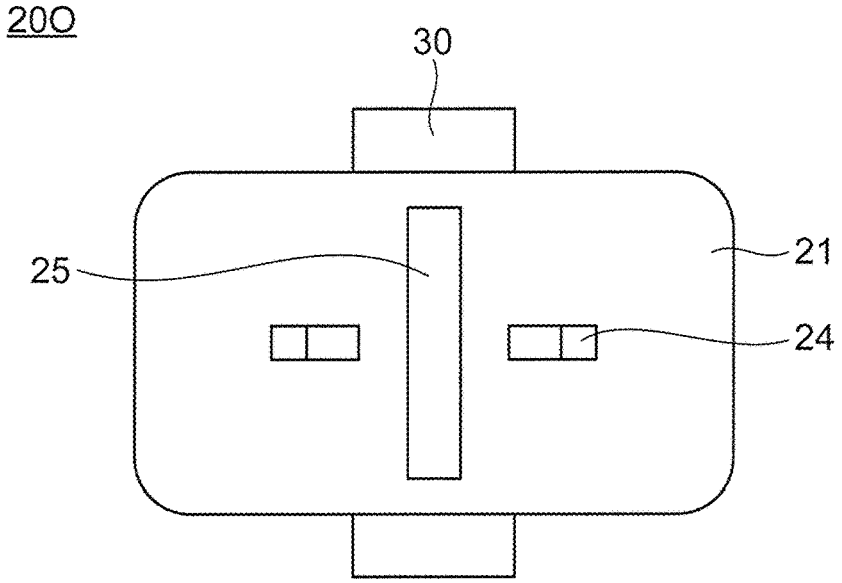
FIG. 33 is a top view of a guide shoe according to a fifteenth embodiment of this invention, which is to be mounted to a step of the passenger conveyor.
Figure 34:
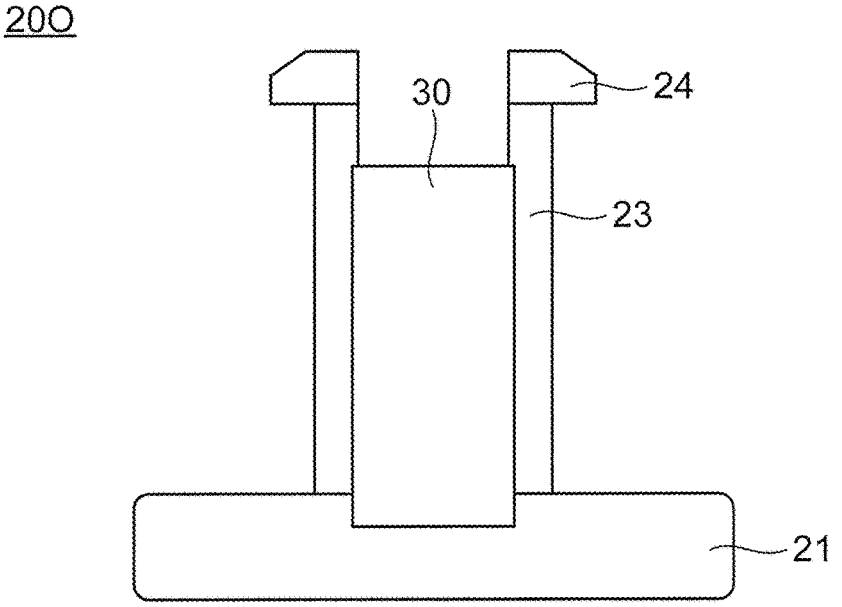
FIG. 34 is a side view of the guide shoe according to the fifteenth embodiment of this invention, which is to be mounted to a step of the passenger conveyor.

FIG. 33 is a top view of a guide shoe 200 according to a fifteenth embodiment of this invention, which is to be mounted to a step of the passenger conveyor. FIG. 34 is a side view of the guide shoe 200 according to the fifteenth embodiment of this invention, which is to be mounted to a step of the passenger conveyor.

In FIG. 33 and FIG. 34, the pair of weights 30 are provided to a pair of long-side side surfaces of the base portion 21, respectively. An end portion of each of the weights 30 on the connector 15 side protrudes toward the connector 15 beyond the back surface of the base portion 21. Other configurations are the same as those of the guide shoe in the fourteenth embodiment described above.

Sixteenth Embodiment

Figure 35:
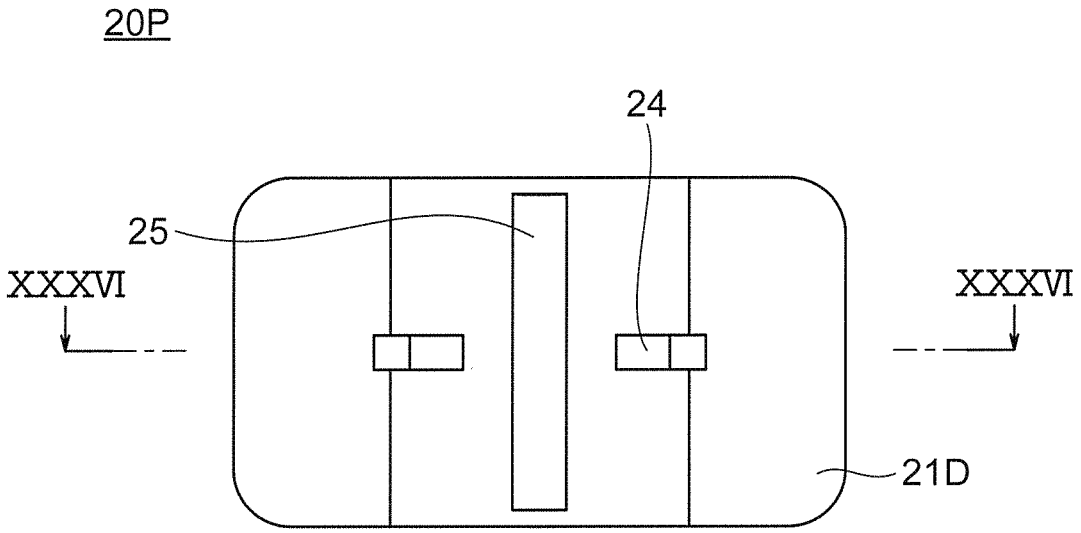
FIG. 35 is a side view of a guide shoe according to a sixteenth embodiment of this invention, which is to be mounted to a step of the passenger conveyor.
Figure 36:
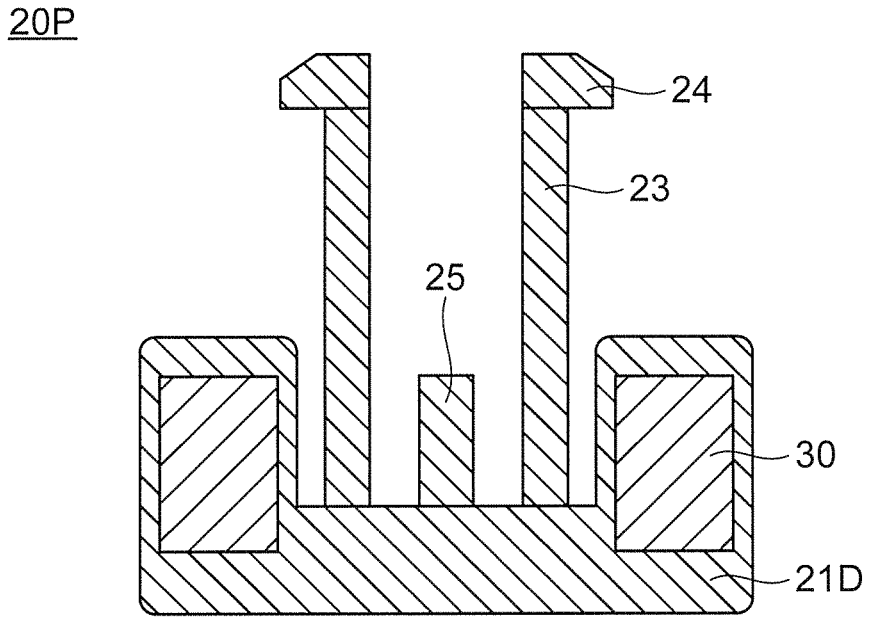
FIG. 36 is a sectional view taken along the line XXXVI-XXXVI in FIG. 35 when viewed in a direction of arrows.

FIG. 35 is a top view of a guide shoe 20P according to a sixteenth embodiment of this invention, which is to be mounted to a step of the passenger conveyor. FIG. 36 is a sectional view taken along the line XXXVI-XXXVI in FIG. 35 when viewed in a direction of arrows.

In FIG. 35 and FIG. 36, similarly to the base portion 21, a base portion 21D is made of a low-friction material. Further, the weights 30 are embedded by insert molding into a front portion and a rear portion of the base portion 21D in the sliding direction across the skirt guard 4. As a result of the embodiment of the weights 30 in the base portion 21D, the back surface of the base portion 21D has portions protruding toward the connector 15.

Seventeenth Embodiment

Figure 37:
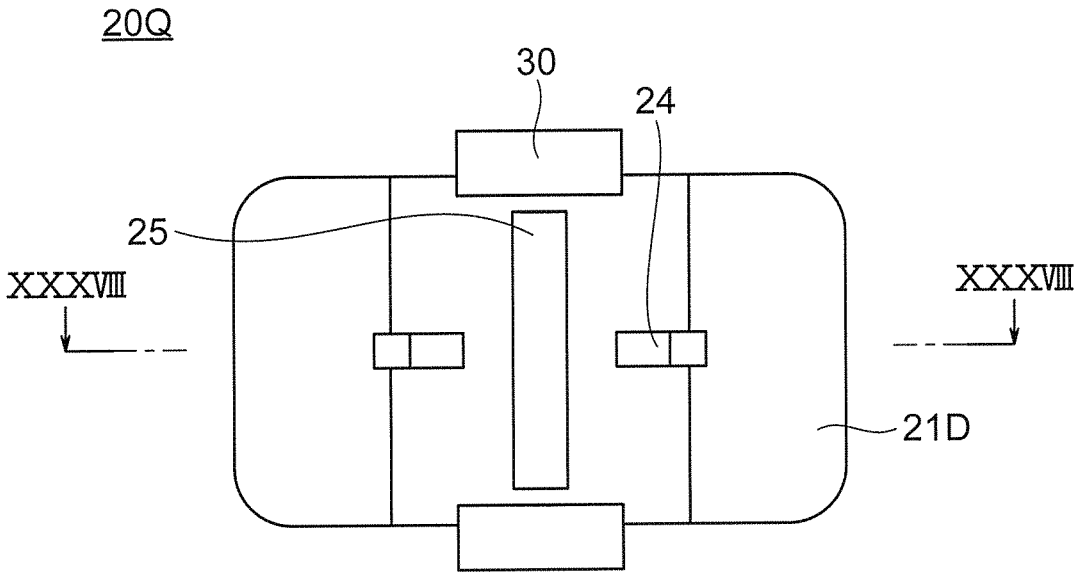
FIG. 37 is a side view of a guide shoe according to a seventeenth embodiment of this invention, which is to be mounted to a step of the passenger conveyor.
Figure 38:
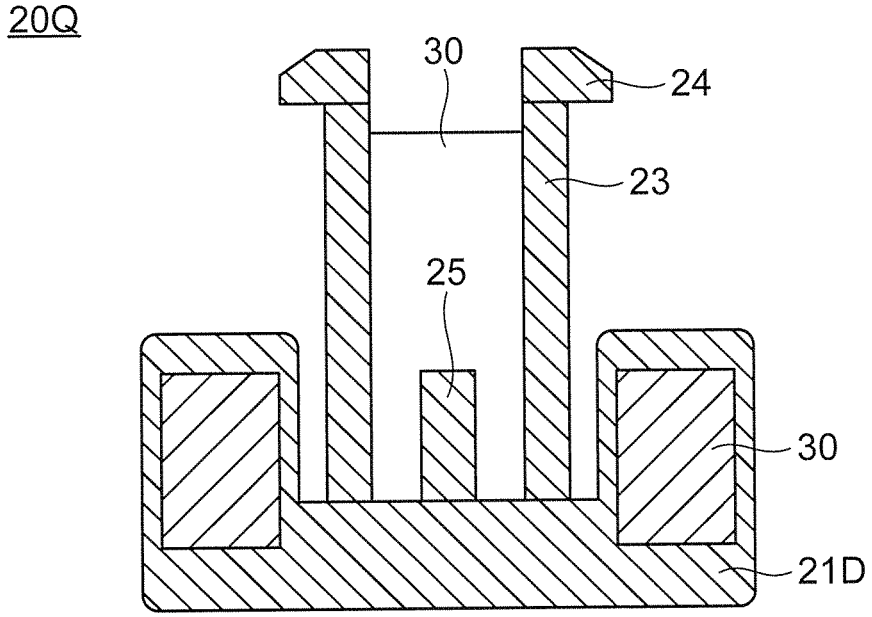
FIG. 38 is a sectional view taken along the line XXXVIII-XXXVIII in FIG. 37 when viewed in a direction of arrows.

FIG. 37 is a top view of a guide shoe according to a seventeenth embodiment of this invention, which is to be mounted to a step of the passenger conveyor. FIG. 38 is a sectional view taken along the line XXXVIII-XXXVIII in FIG. 37 when viewed in a direction of arrows.

In FIG. 37 and FIG. 38, the pair of weights 30 are provided on the back surface of the base portion 21D. Other configurations are the same as those of the guide shoe in the sixteenth embodiment.

Eighteenth Embodiment

Figure 39:
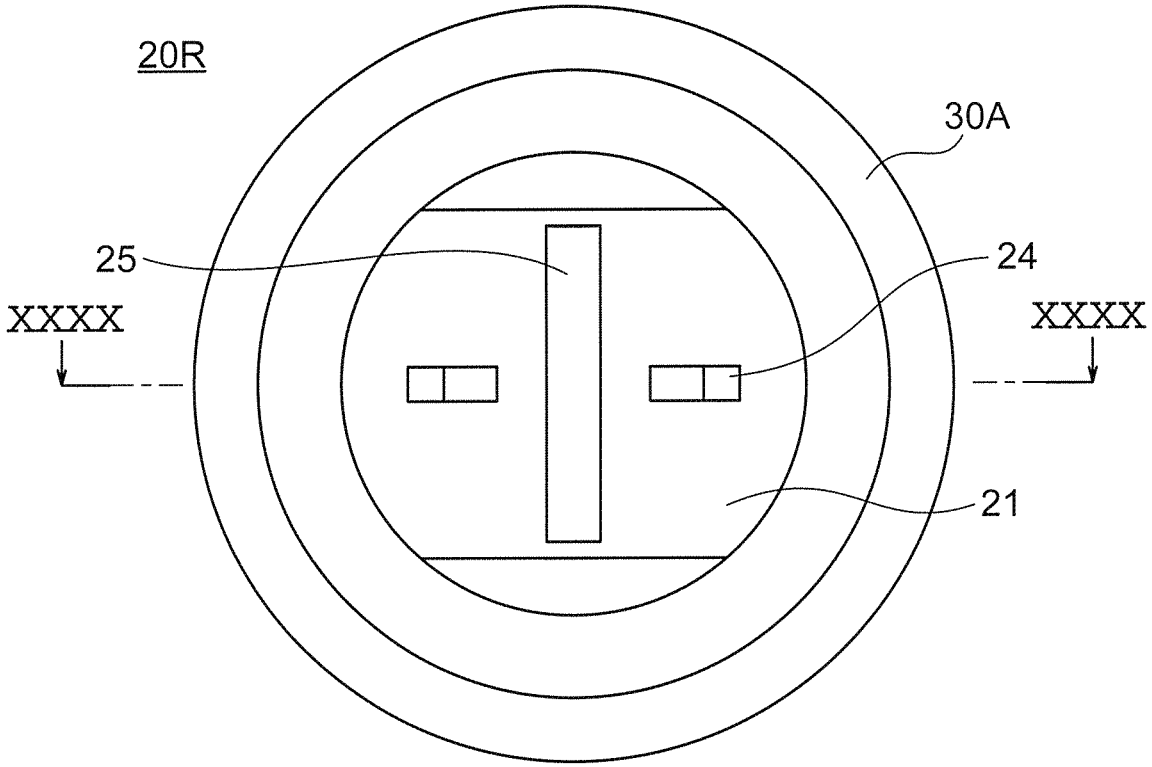
FIG. 39 is a side view of a guide shoe according to an eighteenth embodiment of this invention, which is to be mounted to a step of the passenger conveyor.
Figure 40:
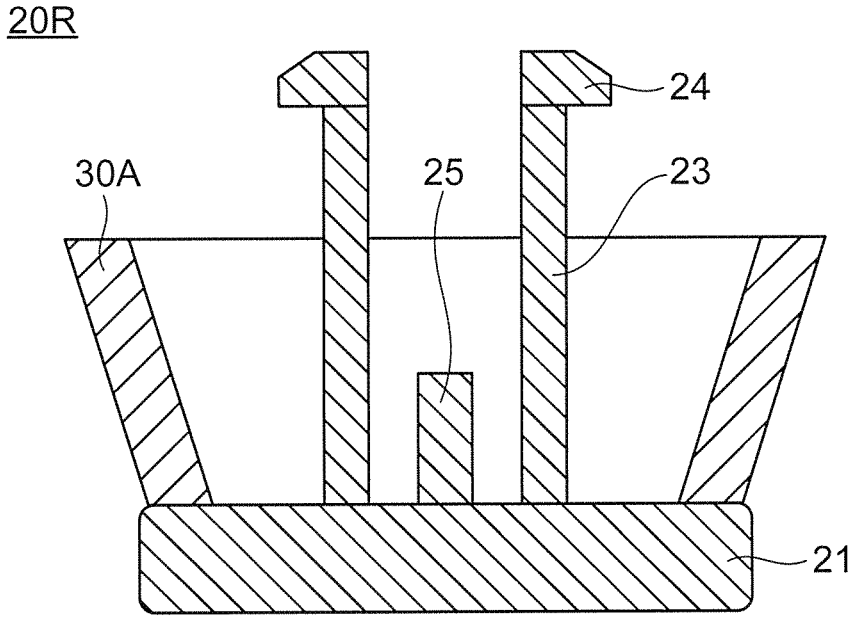
FIG. 40 is a sectional view taken along the line XXXX-XXXX in FIG. 39 when viewed in a direction of arrows.

FIG. 39 is a top view of a guide shoe according to an eighteenth embodiment of this invention, which is to be mounted to a step of the passenger conveyor. FIG. 40 is a sectional view taken along the line XXXX-XXXX in FIG. 39 when viewed in a direction of arrows.

In FIG. 39 and FIG. 40, a weight 30B has a conical tube-like shape, which is an annular shape without a tapered distal end of a cone. A tapered side of the weight 30B is placed in contact with the back surface of the base portion 21.

According to the eighteenth embodiment, the weight 30B has an annular conical tube-like shape. Thus, the gravity-center distance of the guide shoe can be ensured without contact of the weight 30B with the connector 15.

Further, in the fourteenth to eighteenth embodiments described above, the weight 30 is made of a material having a specific gravity larger than that of a material of the base portion 21.

Further, the weight 30 is formed in such a manner as to be integrated with the base portion 21 by integral molding with the base portion 21, bonding, or welding. The weight 30 may be made of a material having a specific gravity larger than that of the material of the base portion 21. As examples of a material having a specific gravity larger than that of the material of the base portion 21, there are given a metal such as iron, aluminum, copper, lead, or tungsten, a stone material, and glass.

In the first to sixth and eighth to thirteenth embodiments described above, the weight 22 is made of a material having a specific gravity larger than that of the material of the base portion 21. However, when the weight 22 is provided at such a position that the moment of inertia about the combined center of gravity of the base portion 21 and the weight(s) 22 becomes larger, the weight 22 may be made of a material having a specific gravity equal to or smaller than the specific gravity of the material of the base portion 21. As examples of a material having a specific gravity equal to or smaller than the specific gravity of the material of the base portion 21, there are given a resin material, a rubber material, and a wood material. With the configuration described above, an increase in weight of the guide shoe can be reduced. Thus, ease of installation and maintenance workability for the passenger conveyor can be improved. In particular, when the same material as the material of the base portion 21 is used as the material of the weight 22, manufacture cost of the guide shoe can be reduced.

Further, in the fourteenth to eighteenth embodiments described above, the weight 30 is made of a material having a specific gravity larger than that of the material of the base portion 21. However, the weight 30 may be made of a material having a specific gravity equal to or smaller than the specific gravity of the material of the base portion 21. As examples of a material having a specific gravity equal to or smaller than the specific gravity of the material of the base portion 21, there are given a resin material, a rubber material, and a wood material. With this configuration, an increase in weight of the guide shoe can be reduced. Thus, ease of installation and maintenance workability for the passenger conveyor can be improved. Further, when the same material as the material of the base portion 21 is used as the material of the weight 30, manufacture cost of the guide shoe 20A can be reduced.

In each of the embodiments described above, the guide shoes are provided on the front wheel side of the step. However, the guide shoes may be provided to the rear wheel side of the step, or may be provided to each of the front wheel side and the rear wheel side.

Further, in each of the embodiments described above, the weight is made of a single material having a specific gravity larger than that of a material of the base portion. However, the weight may be made of a plurality of materials as long as the plurality of materials include a material having a specific gravity larger than that of the material of the base portion. Further, even when a fixing member configured to fix the weight to the base portion functions as a part of the weight configured to add a mass to the base portion, the fixing member is not always required to be made of a material having a specific gravity larger than that of a material of the base portion.

In each of the embodiments, the weight is formed in a rectangular parallelepiped shape, a flat ring-like shape, a rod-like shape, or other shapes. However, the weight may have any geometric shape as long as the weight has a given weight or has a specific gravity larger than that of the base portion, and the weight is in contact with the base portion. As examples of other shapes, there are given a cubic block, a circular plate, a round rod, a pipe, a hexagonal member, an angle bar, a C-shaped steel member, and an angle block. Further, in view of component cost, widely distributed standard items and commercially available items such as a screw, a nut, a shim, a washer, a collar, a ring, and a pin may be directly used as the weight. Further, in terms of installation and maintenance workability, a shim tape having both of a function of the weight and an adhering function may be used as the weight.

Further, this invention is not limited to each of the embodiments described above, and this invention includes all the possible combinations of those features.

REFERENCE SIGNS LIST

1 floor plate, 2 balustrade, 4 skirt guard, 10 step, 15 connector, 20A-20R guide shoe, 21,21A-21D base portion, 22,22A-22D, 30 weight, 23 leg portion.

The invention claimed is:

1. A guide shoe for a passenger conveyor, comprising:
a base portion to be slid across a skirt guard disposed along a moving direction of a plurality of movable steps;
a weight at the base portion; and
a clearance between the weight and a connector of each of the plurality of movable steps, and
wherein the connector is to hold the base portion.

2. The guide shoe for a passenger conveyor according to claim 1, wherein the base portion has a back surface on a side opposite to the sliding surface thereof, and the weight is on the back surface.

3. A passenger conveyor, comprising:
a plurality of the guide shoe for a passenger conveyor of claim 1;
the plurality of steps that are movable; and
a plurality of the skirt guard disposed along the moving direction of the plurality of steps,
wherein the plurality of the guide shoes are mounted to each of the steps.

4. A guide shoe for a passenger conveyor, comprising:
a base portion to be slid across a skirt guard disposed along a moving direction of a plurality of movable steps; and
a weight at the base portion,
wherein the weight is at such a position that a moment of inertia about a combined center of gravity of the base portion and the weight is larger than a moment of inertia about a center of gravity of the base portion in a plane that is orthogonal to a sliding surface of the skirt guard and a sliding surface of the base portion, on which the sliding occurs, and extends along a sliding direction in which the base portion is slid across the skirt guard.

5. The guide shoe for a passenger conveyor according to claim 4, wherein the base portion has a back surface on a side opposite to the sliding surface thereof, and the weight is on the back surface.

6. A passenger conveyor, comprising:
a plurality of the guide shoe for a passenger conveyor of claim 4;
the plurality of steps that are movable; and
a plurality of the skirt guard disposed along the moving direction of the plurality of steps,
wherein the plurality of the guide shoes are mounted to each of the steps.

7. A guide shoe for a passenger conveyor, comprising:
a base portion to be slid across a skirt guard disposed along moving direction of a plurality of movable steps; and
a weight at the base portion,
wherein the weight is at such a position that a distance from a contact point between the skirt guard and the base portion to a combined center of gravity of the base portion and the weight is larger than a distance from the contact point between the skirt guard and the base portion to a center of gravity of the base portion.

8. The guide shoe for a passenger conveyor according to claim 7, wherein the base portion has a back surface on a side opposite to the sliding surface thereof, and the weight is on the back surface.

9. A passenger conveyor, comprising:
a plurality of the guide shoe for a passenger conveyor of claim 7;
the plurality of steps that are movable; and
a plurality of the skirt guard disposed along the moving direction of the plurality of steps,
wherein the plurality of the guide shoes are mounted to each of the steps.

10. A guide shoe for a passenger conveyor, comprising:
a base portion to be slid across a skirt guard disposed along a moving direction of a plurality of movable steps; and
a weight at the base portion,
wherein the base portion has a sliding surface to be slid across the skirt guard and side surfaces orthogonal to the sliding surface, and the weight is on each of the side surfaces.

11. The guide shoe for a passenger conveyor according to claim 10, wherein the base portion has a back surface on a side opposite to the sliding surface thereof, and the weight is on the back surface.

12. A passenger conveyor, comprising:
a plurality of the guide shoe for a passenger conveyor of claim 10;
the plurality of steps that are movable; and
a plurality of the skirt guard disposed along the moving direction of the plurality of steps,
wherein the plurality of the guide shoes are mounted to each of the steps.

* * * * *